US010233916B2

(12) United States Patent
Cai et al.

(10) Patent No.: US 10,233,916 B2
(45) **Date of Patent: *Mar. 19, 2019**

(54) ECCENTRIC ROUNDEL STRUCTURE FOR FOUR-BOOSTER CHAMBER DIAPHRAGM PUMP

(71) Applicants: Ying Lin Cai, Guangdong (CN); Chao Fou Hsu, Kaohsiung (TW)

(72) Inventors: Ying Lin Cai, Guangdong (CN); Chao Fou Hsu, Kaohsiung (TW)

( * ) Notice: Subject to any disclaimer, the term of this patent is extended or adjusted under 35 U.S.C. 154(b) by 317 days.

This patent is subject to a terminal disclaimer.

(21) Appl. No.: 14/885,009

(22) Filed: Oct. 16, 2015

(65) Prior Publication Data

US 2016/0108902 A1 Apr. 21, 2016

Related U.S. Application Data

(60) Provisional application No. 62/065,832, filed on Oct. 20, 2014.

(51) Int. Cl.
*F04B 43/02* (2006.01)
*F04B 43/00* (2006.01)
*F04B 43/04* (2006.01)

(52) U.S. Cl.
CPC ..... *F04B 43/026* (2013.01); *F04B 43/0045* (2013.01); *F04B 43/0054* (2013.01); *F04B 43/02* (2013.01); *F04B 43/025* (2013.01); *F04B 43/04* (2013.01)

(58) Field of Classification Search
CPC ..... F04B 43/02; F04B 43/025; F04B 43/026; F04B 43/0045; F04B 43/0054
USPC ..... 417/269
See application file for complete search history.

(56) References Cited

U.S. PATENT DOCUMENTS 2,991,723 A * 7/1961 Zubaty ..... F04B 43/0045 417/269
4,515,531 A * 5/1985 Roser ..... F04B 43/02 417/269
4,915,018 A * 4/1990 Scott ..... F04B 43/0054 92/100
5,529,468 A * 6/1996 Tuck, Jr. ..... F04B 43/0054 417/474
6,840,745 B1 1/2005 Macauley et al.
7,424,847 B2 9/2008 Hart
(Continued)

*Primary Examiner* — Peter J Bertheaud
(74) *Attorney, Agent, or Firm* — Bacon & Thomas, PLLC

(57) ABSTRACT

The present invention provides an eccentric roundel structure for four-booster-chamber diaphragm pump. The eccentric roundel structure is a truncated-cylinder eccentric roundel in an eccentric roundel mount. The truncated-cylinder eccentric roundel characteristically comprises an annular positioning dent, a truncated cylinder peripheral and a sloped top ring created from the annular positioning dent to the truncated cylinder peripheral to replace a conventional rounded shoulder. By means of the sloped top ring, the oblique pull and squeezing phenomena of high frequency incurred by the rounded shoulder in a conventional tubular eccentric roundel are completely eliminated. Thus, not only the durability of the four-booster-chamber diaphragm pump for sustaining the pumping action of high frequency from the truncated-cylinder eccentric roundels is mainly enhanced but also the service lifespan of the four-booster-chamber diaphragm pump is exceedingly prolonged.

8 Claims, 38 Drawing Sheets

(56) References Cited

U.S. PATENT DOCUMENTS

| | | | | |
|---|---|---|---|---|
| 7,887,304 | B2 * | 2/2011 | Cai | F04B 53/1065 417/271 |
| 8,393,878 | B2 * | 3/2013 | Cai | F04B 53/1065 417/269 |
| 8,845,309 | B2 * | 9/2014 | Cai | F04B 43/026 137/510 |
| 9,169,837 | B2 * | 10/2015 | Pascual | F04B 43/026 |
| 9,945,372 | B2 * | 4/2018 | Cai | F04B 45/027 |
| 9,989,046 | B2 * | 6/2018 | Cai | F04B 53/14 |

* cited by examiner

ECCENTRIC ROUNDEL STRUCTURE FOR FOUR-BOOSTER CHAMBER DIAPHRAGM PUMP

This application claims the benefit of provisional U.S. Patent Application number 62/065,832, filed Oct. 20, 2014, and incorporated herein by reference.

FIELD OF THE PRESENT INVENTION

The present invention relates to an eccentric roundel structure for four-booster chamber diaphragm pump of RO (reverse osmosis) purification system used in household or recreational vehicle, particularly for one characteristically having a sloped top ring that can eliminate the oblique pull and squeezing phenomena incurred by a conventional rounded shoulder of the pump so that the service lifespan of the four-booster chamber diaphragm pump and the durability of key component therein are prolonged.

BACKGROUND OF THE INVENTION

Currently, the conventional compressing diaphragm pumps exclusively used with RO (Reverse Osmosis) purifier or RO water purification system, which is popularly installed on the water supplying apparatus in either the settled home, recreational vehicle or mobile home, have some various types. For four-booster-chamber diaphragm pumps, other than the specific type as disclosed in the U.S. Pat. No. 6,840,745, the majority of conventional four-booster-chamber diaphragm pumps can be categorized as similar design as shown in FIGS. 1 through 10. An essential configuration of the conventional four-booster-chamber diaphragm pumps aforesaid can be generalized as similar design as shown in FIGS. 1 through 10, which essentially comprises a motor 10 with an output shaft 11, a motor upper chassis 30, a wobble plate with integral protruding cam-lobed shaft 40, an eccentric roundel mount 50, a pump head body 60, a diaphragm membrane 70, four pumping pistons 80, a piston valvular assembly 90 and a pump head cover 20, wherein said motor upper chassis 30 includes a bearing 31 to be run through by the output shaft 11 of the motor 10, an upper annular rib ring 32 with several internal and external fastening bores 33 evenly disposed inner and outer of circumferential rim thereof; said wobble plate with integral protruding cam-lobed shaft 40 includes a shaft coupling hole 41 for being run through by the corresponding motor output shaft 11 of the motor 10; said eccentric roundel mount 50 includes a central bearing 51 securely fitted at the bottom base thereof for engaging with the corresponding wobble plate with integral protruding cam-lobed shaft 40, four truncated-cylinder eccentric roundels 52 disposed on the bottom base thereof in circumferential location evenly such that each truncated-cylinder eccentric roundel 52 has a horizontal top face 53, a truncated cylinder peripheral 56, a female-threaded bore 54 and an annular positioning dent 55 formed on the top face thereof respectively in horizontal flush, as well as a rounded shoulder 57 created at the joint of the horizontal top face 53 and truncated cylinder peripheral 56; said pump head body 60, which suitably covers on the upper annular rib ring 32 of the motor upper chassis 30 to encompass the wobble plate with integral protruding cam-lobed shaft 40 and eccentric roundel mount 50 therein, includes four operating holes 61 disposed therein in circumferential location evenly such that each operating hole 61 has inner diameter slightly bigger than outer diameter of the corresponding truncated-cylinder eccentric roundel 52 in the eccentric roundel mount 50 for receiving each corresponding truncated-cylinder eccentric roundel 52 respectively, a lower annular flange 62 formed thereunder for mating with corresponding upper annular rib ring 32 of the motor upper chassis 30, several internal and external fastening bores 63 evenly disposed inner and outer of circumferential thereof; said diaphragm membrane 70, which is extrude-molded by semi-rigid elastic material and to be placed on the pump head body 60, includes a pair of parallel outer raised brim 71 and inner raised brim 72 as well as four evenly spaced radial raised partition ribs 73 such that each inner end of radial raised partition rib 73 connects with the inner raised brim 72 so that four equivalent piston acting zones 74 are formed and partitioned by the radial raised partition ribs 73, wherein each piston acting zone 74 has an acting zone hole 75 created therein in correspondence with each female-threaded bore 54 in the truncated-cylinder eccentric roundel 52 of the eccentric roundel mount 50 respectively, and an annular positioning protrusion 76 for each acting zone hole 75 is formed at the bottom side of the diaphragm membrane 70 (as shown in FIGS. 8 and 9); each said pumping piston 80, which is respectively placed in each corresponding piston acting zones 74 of the diaphragm membrane 70, has a tiered hole 81 run through thereof so that each said pumping piston 80 is respectively disposed in each corresponding piston acting zones 74 of the diaphragm membrane 70 after having each annular positioning protrusion 76 in the diaphragm membrane 70 inserted into each corresponding annular positioning dent 55 in the truncated-cylinder eccentric roundel 52 of the eccentric roundel mount 50 by running fastening screw 1 through the tiered hole 81 of each pumping piston 80 and the acting zone hole 74 of each corresponding piston acting zone 74 in the diaphragm membrane 70 with result that the diaphragm membrane 70 and four pumping pistons 80 can be securely screwed into each female-threaded bore 54 of corresponding four truncated-cylinder eccentric roundels 52 in the eccentric roundel mount 50 (as enlarged view shown in FIG. 10 of association); said piston valvular assembly 90 includes a downward outlet raised brim 91 to insert an indented brim formed between the outer raised brim 71 and inner raised brim 72 in the diaphragm membrane 70, a central dish-shaped round outlet mount 92 having a central positioning bore 93 with four equivalent sectors such that each sector contains a group of multiple evenly circum-located outlet ports 95, a T-shaped plastic anti-backflow valve 94 with a central positioning shank, and four circumjacent inlet mounts 96 such that each inlet mount 96 includes a group of multiple evenly circum-located inlet ports 97 and an inverted central piston disk 98 respectively so that each piston disk 98 serves as a valve for each corresponding group of multiple inlet ports 97, wherein the central positioning shank of the plastic anti-backflow valve 94 mates with the central positioning bore 93 of the central outlet mount 92 such that each group of multiple outlet ports 95 in each sector of the central round outlet mount 92 is communicable with each corresponding group of inlet ports 97 in each corresponding inlet mount 96, and a hermetical pressure booster chamber 26 is formed between each inlet mount 96 and corresponding piston acting zone 74 in the diaphragm membrane 70 upon the downward outlet raised brim 91 having inserted the indented brim formed between the outer raised brim 71 and inner raised brim 72 in the diaphragm membrane 70 (as enlarged view shown in FIG. 10 of association); and said pump head cover 20, which directly covers on the pump head body 60 to encompass the piston valvular assembly 90, four pumping pistons 80 and diaphragm membrane 70 therein, includes a water inlet orifice 21, a water outlet orifice 22, and several internal and external fastening bores 23 while a tiered rim 24 and an annular rib ring 25 are disposed in the bottom inside thereof so that the outer brim of the pump head cover 20 after assembling of diaphragm membrane 70 and piston valvular assembly 90 can hermetically attach on the tiered rim 24 (as enlarged view shown in FIG. 10 of association), wherein a compressing chamber 27 is configured between cavity formed by the inside wall of the annular rib ring 25 and the central outlet mount 91 of the piston valvular assembly 90 upon having the bottom of the annular rib ring 25 closely covered on the brim of the central outlet mount 92 (as shown in FIG. 10).

By running each internal and external fastening bolt 2 through the each corresponding internal and external fastening bores 23 of pump head cover 20 and each corresponding internal and external fastening bore 63 in the pump head body 60 as well as each corresponding internal fastening bore 33 in the motor upper chassis 30, then putting a nut 3 onto each external fastening bolt 2 to securely screw each corresponding external fastening bore 33 in the pump head cover 20 and pump head body 60 so that the assembly of the four-booster-chamber diaphragm pump is finished (as shown in FIGS. 1 and 10).

Please refer to FIGS. 11 and 12, which are illustrative figures for the operation of conventional four-booster-chamber diaphragm pump aforesaid. When the motor 10 is powered on, the wobble plate 40 is driven to rotate by the motor output shaft 11 so that four truncated-cylinder eccentric roundels 52 on the eccentric roundel mount 50 orderly move in up-and-down reciprocal stroke constantly; Meanwhile, four pumping pistons 80 and four piston acting zones 74 in the diaphragm membrane 70 are orderly driven by the up-and-down reciprocal stroke of four truncated-cylinder eccentric roundels 52 to move in up-and-down displacement; As the truncated-cylinder eccentric roundel 52 moves in "down stroke" with pumping piston 80 and piston acting zone 74 in down displacement, the piston disk 98 in the piston valvular assembly 90 is pushed into "open" status so that the tap water W can flow into the pressure booster chamber 26 orderly via water inlet orifice 21 in the pump head cover 20 and inlet ports 97 in the piston valvular assembly 90 (as shown in FIG. 11 and arrowhead indication W in enlarged view of association) while the truncated-cylinder eccentric roundel 52 moves in "up stroke" with pumping piston 80 and piston acting zone 74 in up displacement, the piston disk 96 in the piston valvular assembly 90 is pulled into "close" status to compress the tap water W in the pressure booster chamber 26 to increase the water pressure therein up to range of 100-150 psi and become into pressurized water Wp with result that the plastic anti-backflow valve 94 in the piston valvular assembly 90 is pushed to "open" status; Since the plastic anti-backflow valve 94 in the piston valvular assembly 90 is pushed to "open" status, the pressurized water Wp in the pressure booster chamber 26 is directed into compressing chamber 27 via group of outlet ports 95 for the corresponding sector in central outlet mount 92, then expelled out of the water outlet orifice 22 in the pump head cover 20 (as shown in FIG. 12 and arrowhead indication Wp in enlarged view of association); consequently, with orderly repeat action for each group of outlet ports 95 for four sectors in central outlet mount 92, the pressurized water Wp is constantly discharged out of the conventional four-booster-chamber diaphragm pump for being further RO-filtered by the RO-cartridge so that the final filtered pressurized water Wp can be used in the RO (Reverse Osmosis) purifier, which is popularly installed on the water supplying apparatus in the settled home, and RO water purification system in the recreational vehicle or mobile home.

Referring to FIGS. 13 and 14, some drawbacks have long-lasting existed in the foregoing conventional four-booster-chamber diaphragm pump as below. As described previously, when the motor 10 is powered on, the wobble plate 40 is driven to rotate by the motor output shaft 11 so that four truncated-cylinder eccentric roundels 52 on the eccentric roundel mount 50 orderly move in up-and-down reciprocal stroke constantly, and four piston acting zones 74 in the diaphragm membrane 70 are orderly driven by the up-and-down reciprocal stroke of four truncated-cylinder eccentric roundels 52 to move in up-and-down displacement so that equivalently a repeated acting force F constantly acting on the bottom side of each said piston acting zone 74. Meanwhile a plurality of rebounding force Fs is created to react the acting force F exerting on the bottom side of diaphragm membrane 70 with different components distributed over entire bottom area of each corresponding piston acting zone 74 in the diaphragm membrane 70 (as distributed component forces shown in FIG. 14) so that a "squeezing phenomenon" happens on the partial portion of the diaphragm membrane 70, which is incurred by the rebounding force Fs. Among all distributed component forces of the rebounding force Fs, the specific component force happened at the contacting bottom position P of the diaphragm membrane 70 with the rounded shoulder 57 of the horizontal top face 53 in the truncated-cylinder eccentric roundel 52 is maximum so that the "squeezing phenomenon" happened here is also maximum (as shown in FIG. 14). With rotational speed for the motor output shaft 11 of the motor 10 reaching a range of 800-1200 rpm, each bottom position P at the piston acting zone 74 of the diaphragm membrane 70 is suffered from the "squeezing phenomenon" in a frequency of four times per second. Under such circumstance, the bottom position P of the diaphragm membrane 70 is always the first broken place for entire conventional four-booster-chamber diaphragm pump, which is the essential cause for not only shortening the service lifespan but also terminating normal function of the conventional four-booster-chamber diaphragm pump.

Therefore, how to substantially reduce all the drawbacks associated with the "squeezing phenomenon" caused by the repeated acting force F constantly acting on the bottom side of each said piston acting zone 74 of the diaphragm membrane 70, which is incurred by the truncated-cylinder eccentric roundel 52, for the conventional four-booster-chamber diaphragm pump becomes an urgent and critical issue.

SUMMARY OF THE INVENTION

The primary object of the present invention is to provide an eccentric roundel structure for four-booster-chamber diaphragm pump. The eccentric roundel structure is a truncated-cylinder eccentric roundel, which is disposed in an eccentric roundel mount, basically comprises an annular positioning dent, a truncated cylinder peripheral and a sloped top ring created from the annular positioning dent to the truncated cylinder peripheral. By means of the sloped top ring, the oblique pull and squeezing phenomena of high frequency incurred in a conventional truncated cylinder eccentric roundel are completely eliminated because the sloped top ring flatly attaches the bottom area of corresponding piston acting zone for a diaphragm membrane. Thus, not only the durability of the diaphragm membrane for sustaining the pumping action of high frequency from the truncated-cylinder eccentric roundel s is mainly enhanced but also the service lifespan of the diaphragm membrane is exceedingly prolonged.

The other object of the present invention is to provide an eccentric roundel structure for four-booster-chamber diaphragm pump. The eccentric roundel structure is a truncated-cylinder eccentric roundel, which is disposed in an eccentric roundel mount, basically comprises an annular positioning dent, a truncated cylinder peripheral and a sloped top ring created from the annular positioning dent to the truncated cylinder peripheral. By means of the sloped top ring, all distributed components of the rebounding force for the truncated-cylinder eccentric roundels reacting to the an acting force caused by the pumping action are substantially reduced because the sloped top ring flatly attaches the bottom area of corresponding piston acting zone for a diaphragm membrane. Thus, some benefits are obtained as below. The durability of the diaphragm membrane for sustaining the pumping action of high frequency from the truncated-cylinder eccentric roundels is mainly enhanced, the power consumption of the four-booster-chamber diaphragm pump is tremendously diminished due to less current being wasted in the "squeezing phenomena" of high frequency, the working temperature of the four-booster-chamber diaphragm pump is tremendously subdued due to less power consumption being used, and the annoying noise of the bearing incurred by the aged lubricant in the four-booster-chamber diaphragm pump, which is expeditiously accelerated by the high working temperature, is mostly eliminated.

DETAILED DESCRIPTION OF THE PREFERRED EMBODIMENTS

Figure 1:
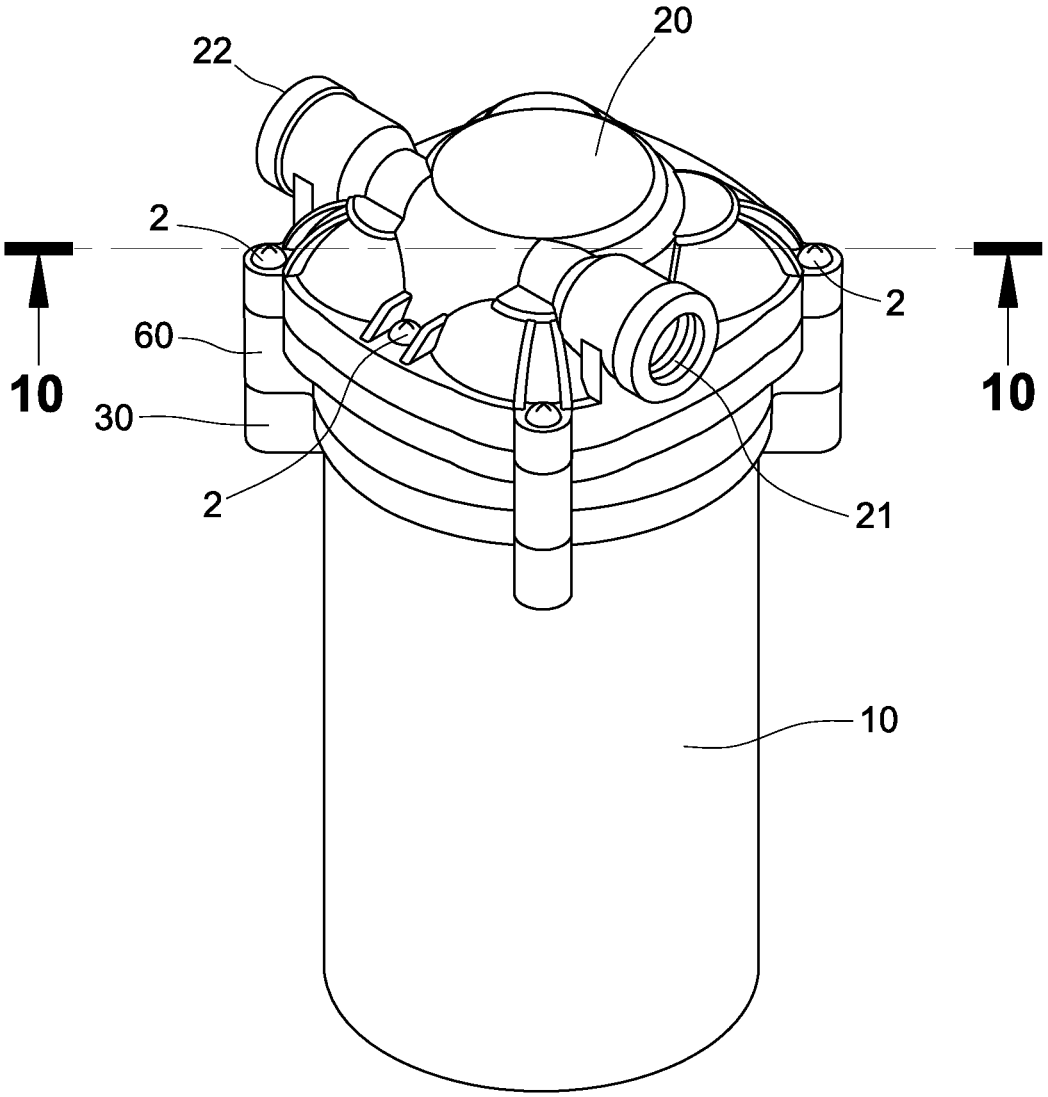
FIG.1 (PRIOR ART)
FIG. 1 is a perspective assembled view for an essential configuration of a conventional four-booster-chamber diaphragm pump.
Figure 2:
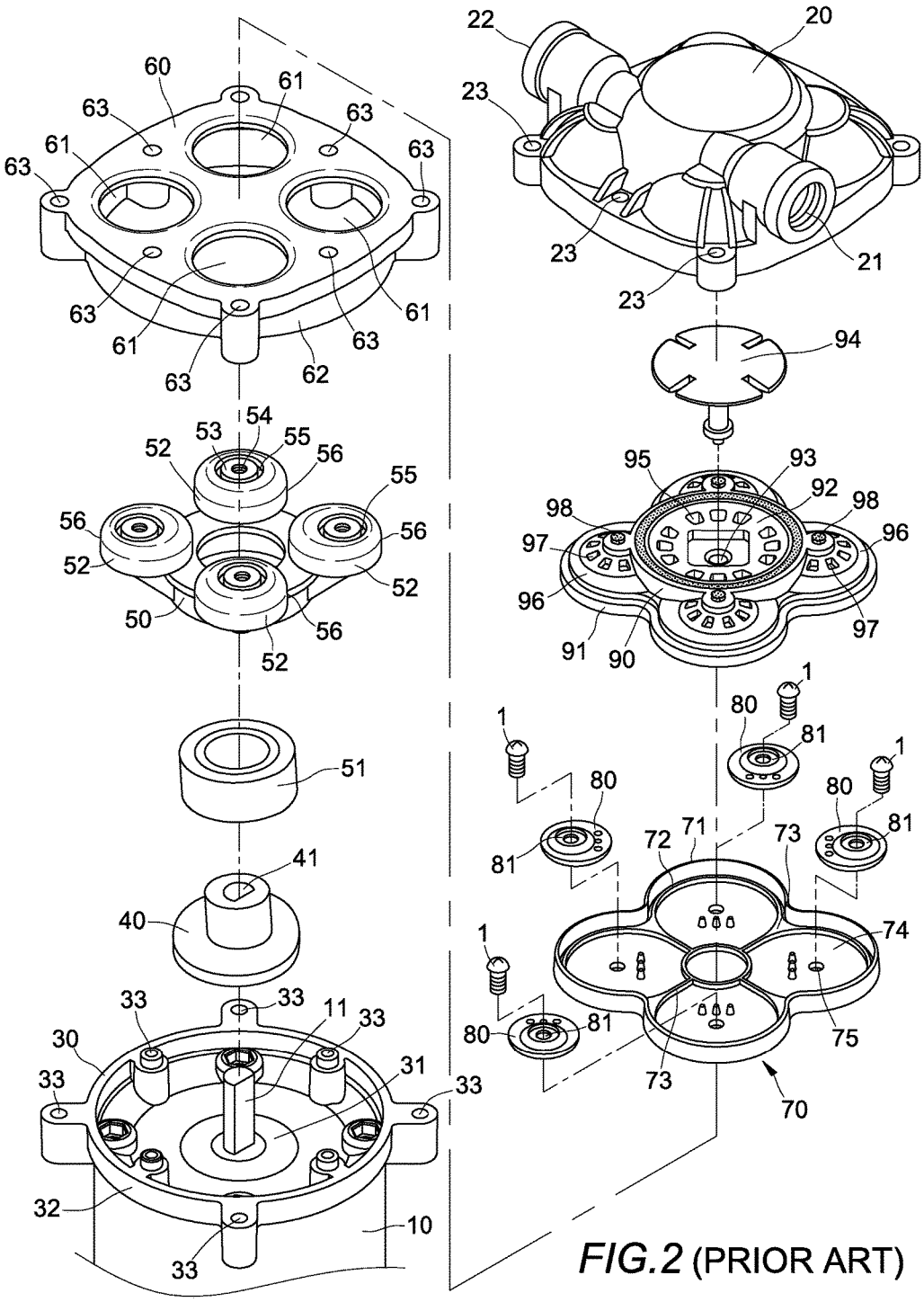
FIG.2 (PRIOR ART)
FIG. 2 is a perspective exploded view for an essential configuration of a conventional four-booster chamber diaphragm pump.
Figure 3:
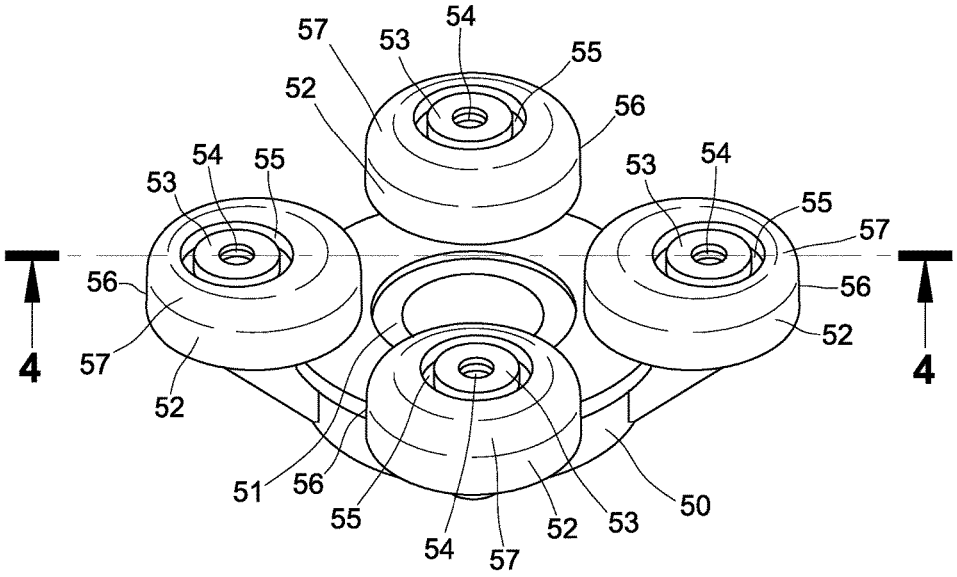
FIG.3 (PRIOR ART)
FIG. 3 is a perspective view for an eccentric roundel mount in an essential configuration of a conventional four-booster-chamber diaphragm pump.
Figure 4:
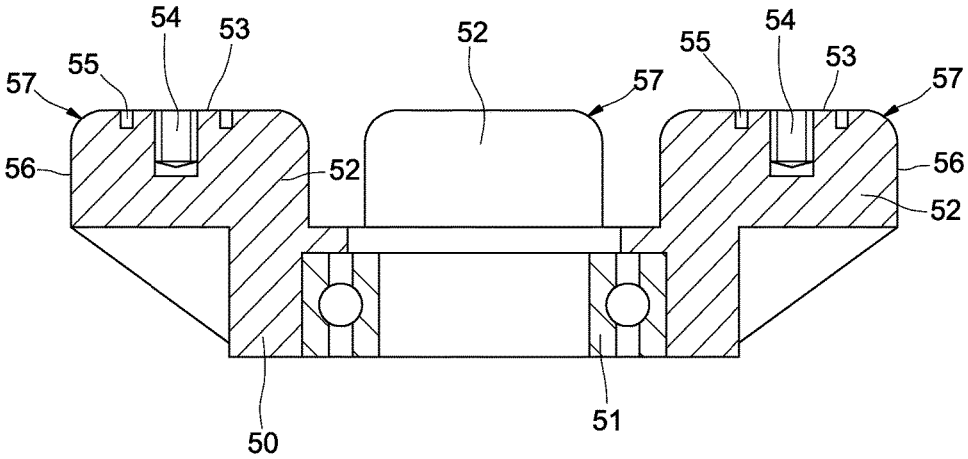
FIG.4 (PRIOR ART)
FIG. 4 is a cross sectional view taken against the section line of 4-4 from previous FIG. 3.
Figure 5:
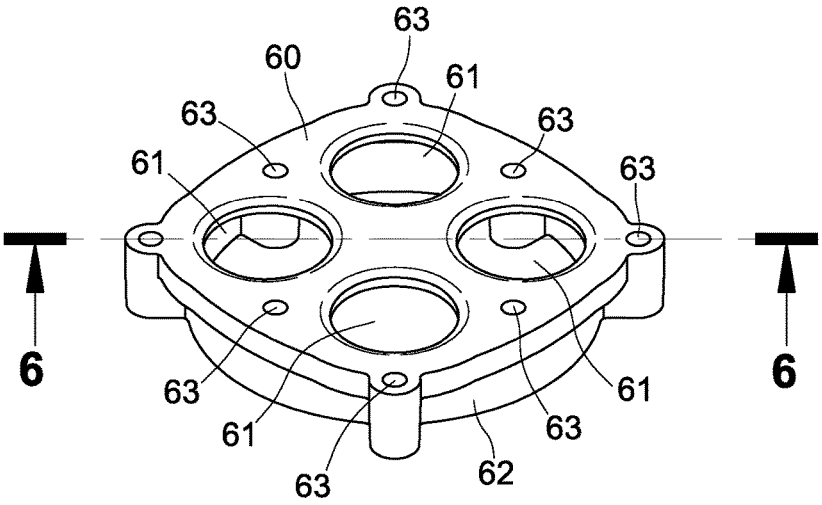
FIG.5 (PRIOR ART)
FIG. 5 is a perspective view for a pump head body in an essential configuration in a conventional four-booster-chamber diaphragm pump.
Figure 6:
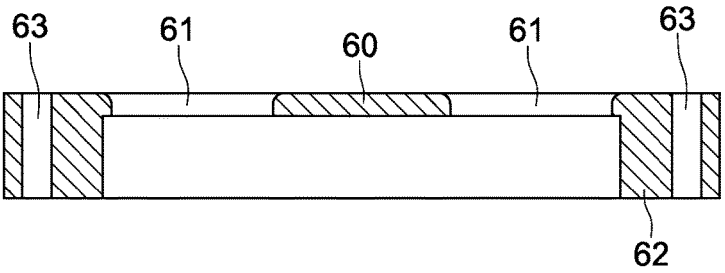
FIG.6 (PRIOR ART)
FIG. 6 is a cross sectional view taken against the section line of 6-6 from previous FIG. 5.
Figure 7:
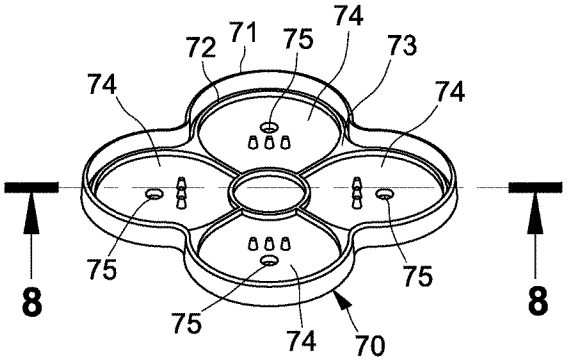
FIG.7 (PRIOR ART)
FIG. 7 is a perspective view for a diaphragm membrane in an essential configuration of a conventional four-booster-chamber diaphragm pump.
Figure 8:
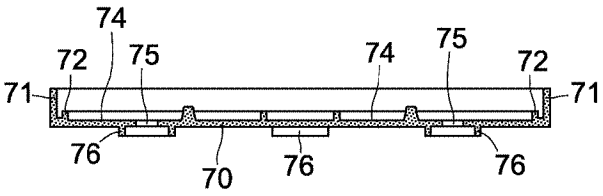
FIG.8 (PRIOR ART)
FIG. 8 is a cross sectional view taken against the section line of 8-8 from previous FIG. 7.
Figure 9:
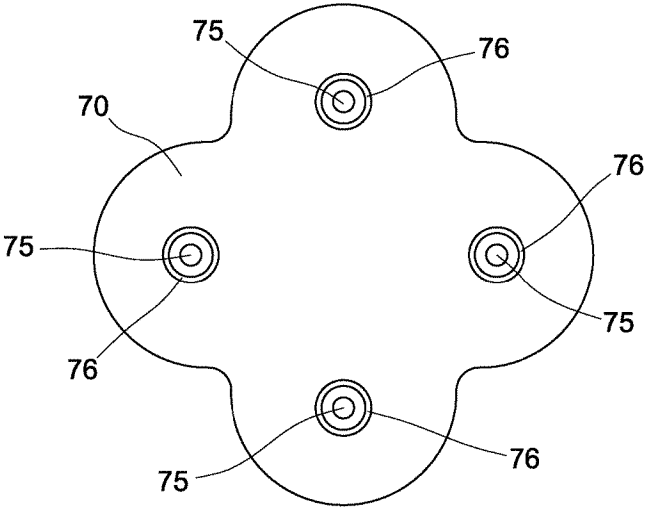
FIG.9 (PRIOR ART)
FIG. 9 is a bottom view for a diaphragm membrane in an essential configuration of a conventional four-booster-chamber diaphragm pump.
Figure 10:
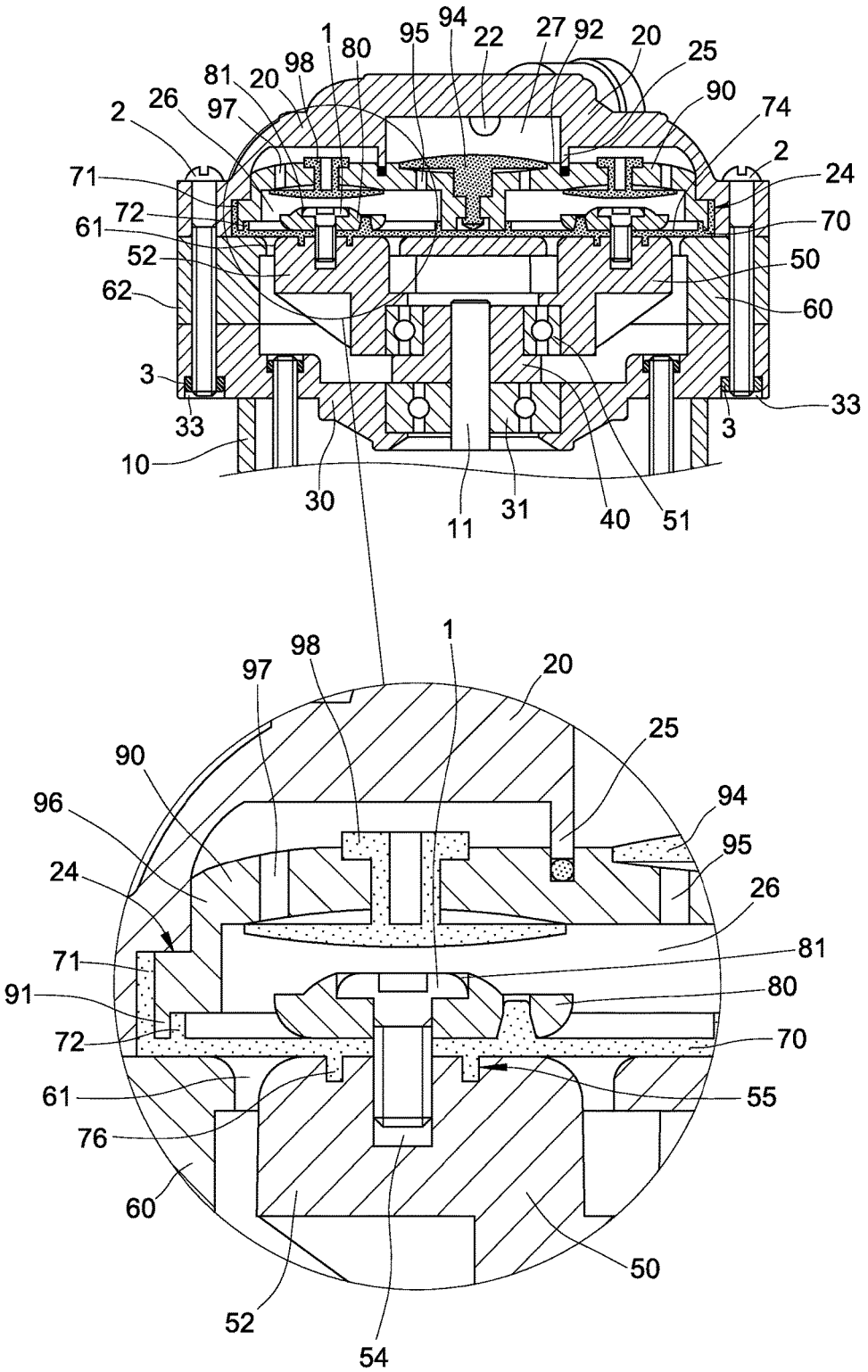
FIG.10 (PRIOR ART)
FIG. 10 is a cross sectional view taken against the section line of 10-10 from previous FIG. 1.
Figure 11:
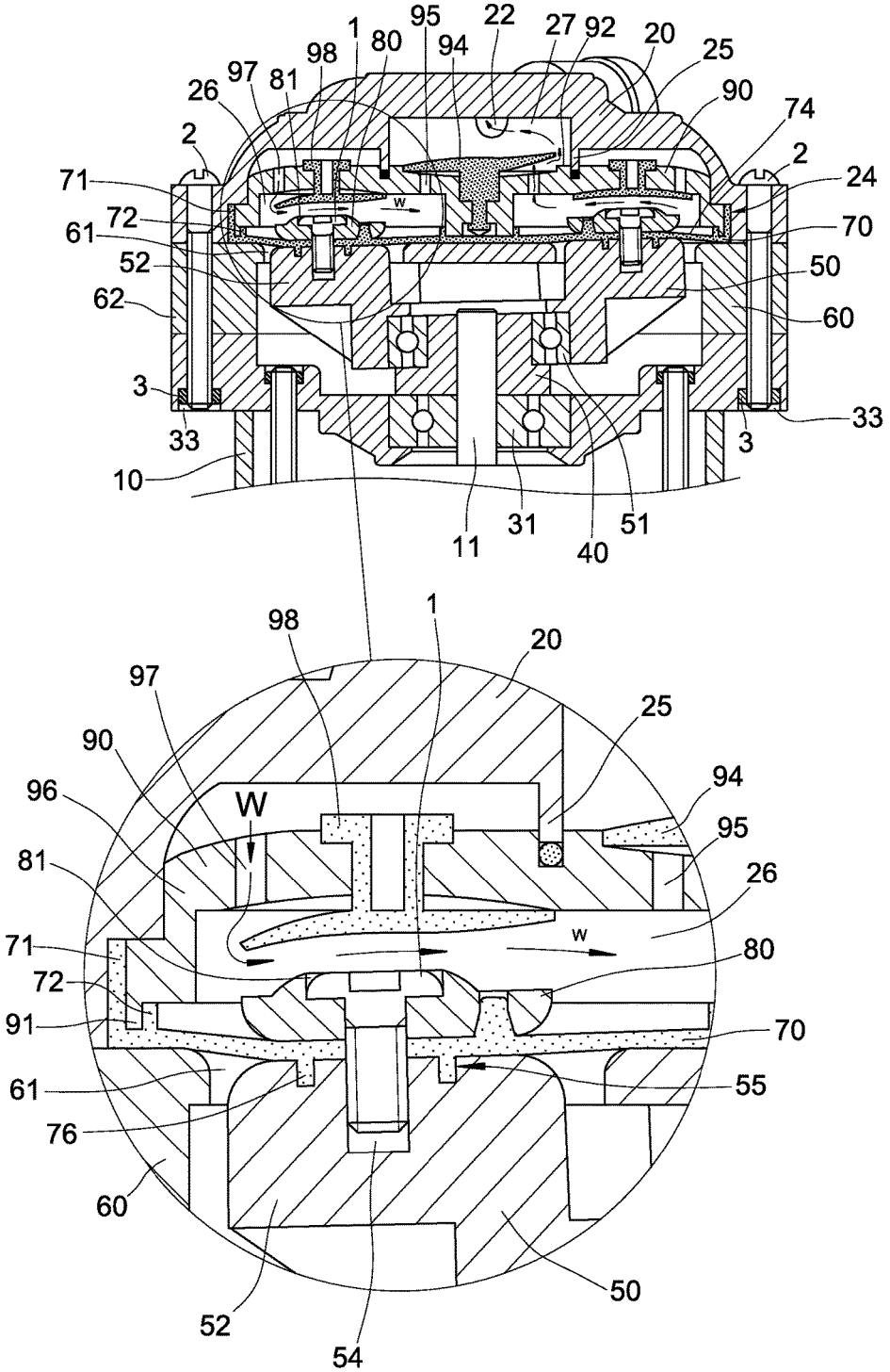
FIG.11 (PRIOR ART)
FIG. 11 is the first operational step illustrative view for an essential configuration of a conventional four-booster-chamber diaphragm pump.
Figure 12:
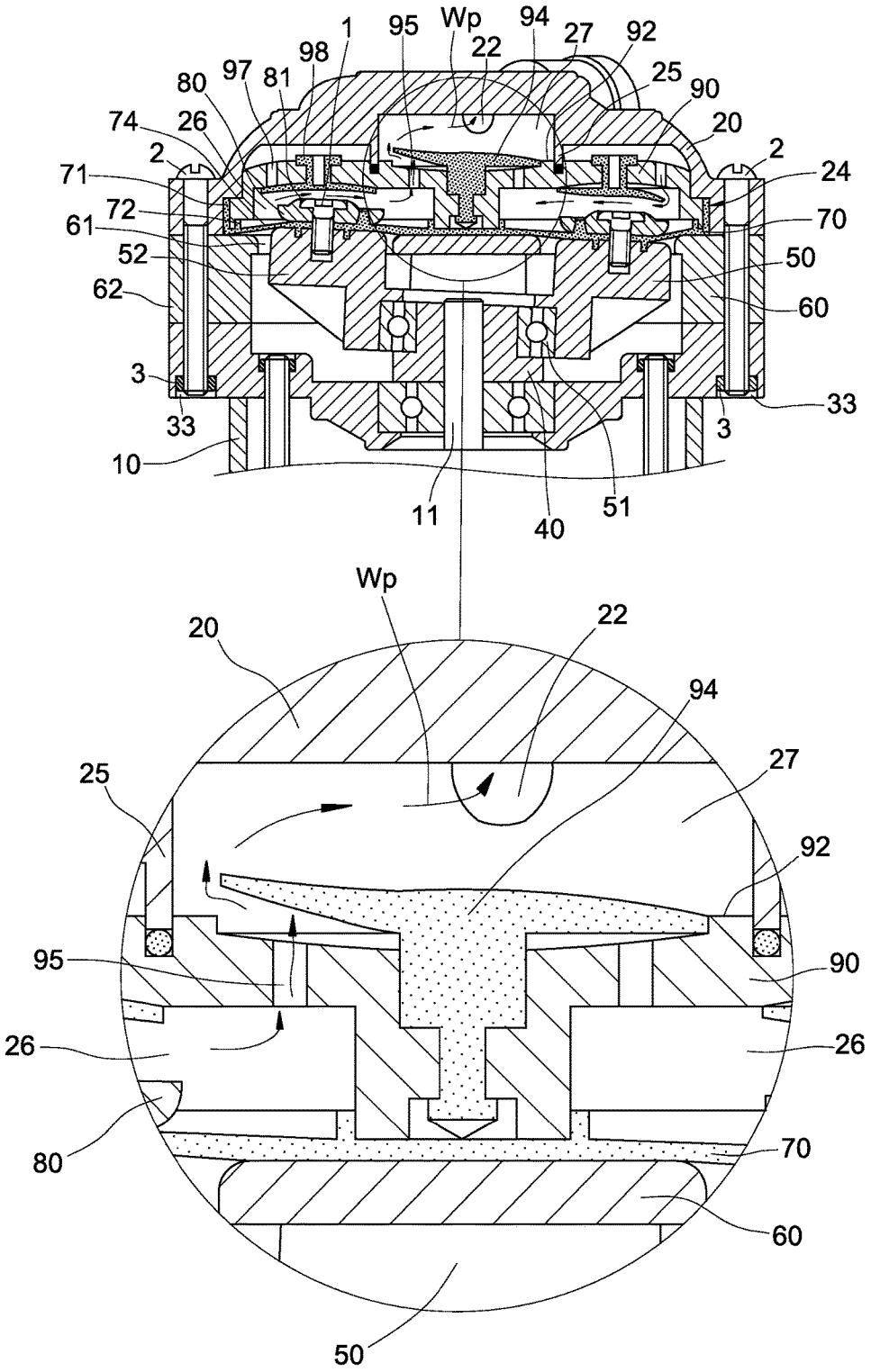
FIG.12 (PRIOR ART)
FIG. 12 is the second operational step illustrative view for an essential configuration of a conventional four-booster-chamber diaphragm pump.
Figure 13:
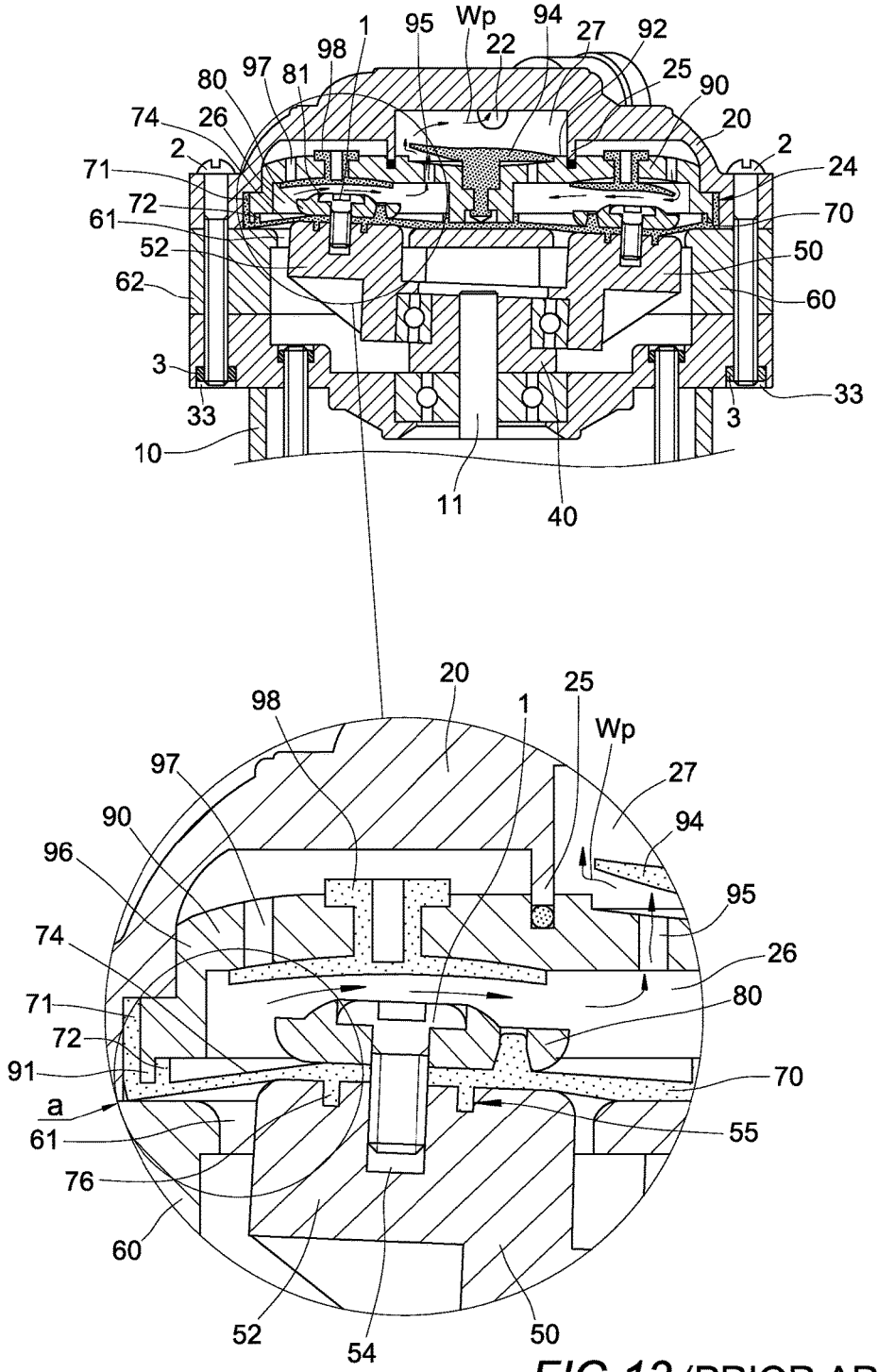
FIG.13 (PRIOR ART)
FIG. 13 is the third operational step illustrative view for an essential configuration of a conventional four-booster-chamber diaphragm pump.

Please refer to FIGS. 15 through 18, which are illustrative figures of "eccentric roundel structure for four-booster-chamber diaphragm pump" in an essential configuration for the first exemplary embodiment of the present invention such that each of the four eccentric roundel structures is a truncated-cylinder eccentric roundel 52 in an eccentric roundel mount 50. Wherein. each truncated-cylinder eccentric roundel 52 characteristically has a truncated cylinder peripheral 56, a female-threaded bore 54 and an annular positioning dent 55 formed in horizontal flush with a horizontal top face 53 respectively, as well as a sloped top rim 58, which is downwardly slanted from the annular positioning dent 55 towards the joint of the horizontal top face 53 and truncated cylinder peripheral 56 to replace the conventional rounded shoulder 57 in each conventional truncated-cylinder eccentric roundel 52 of the eccentric roundel mount 50.

Figure 19:
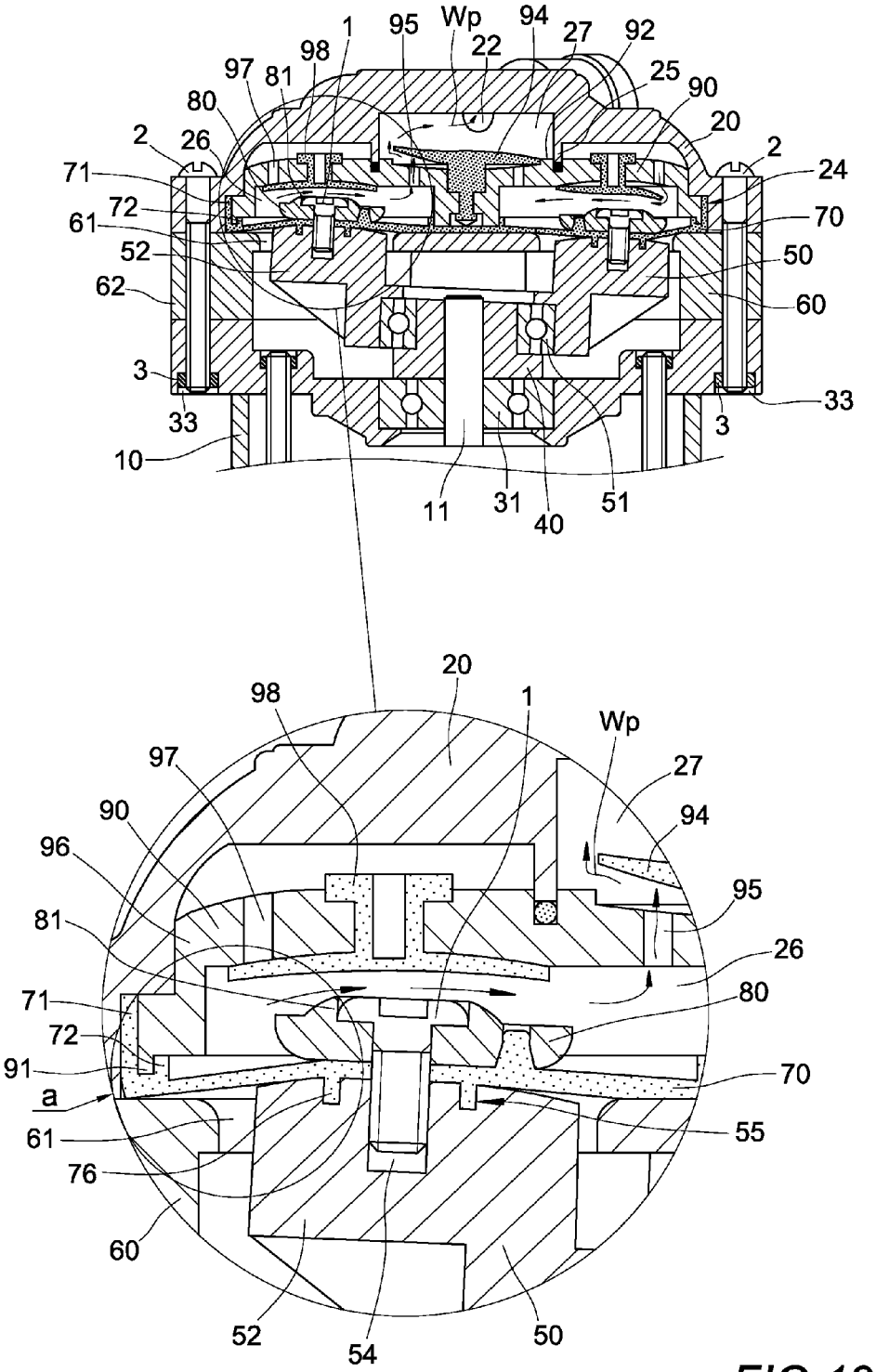
FIG. 19 is an operation illustrative view for the first exemplary embodiment in an essential configuration of the present invention.
Figure 20:
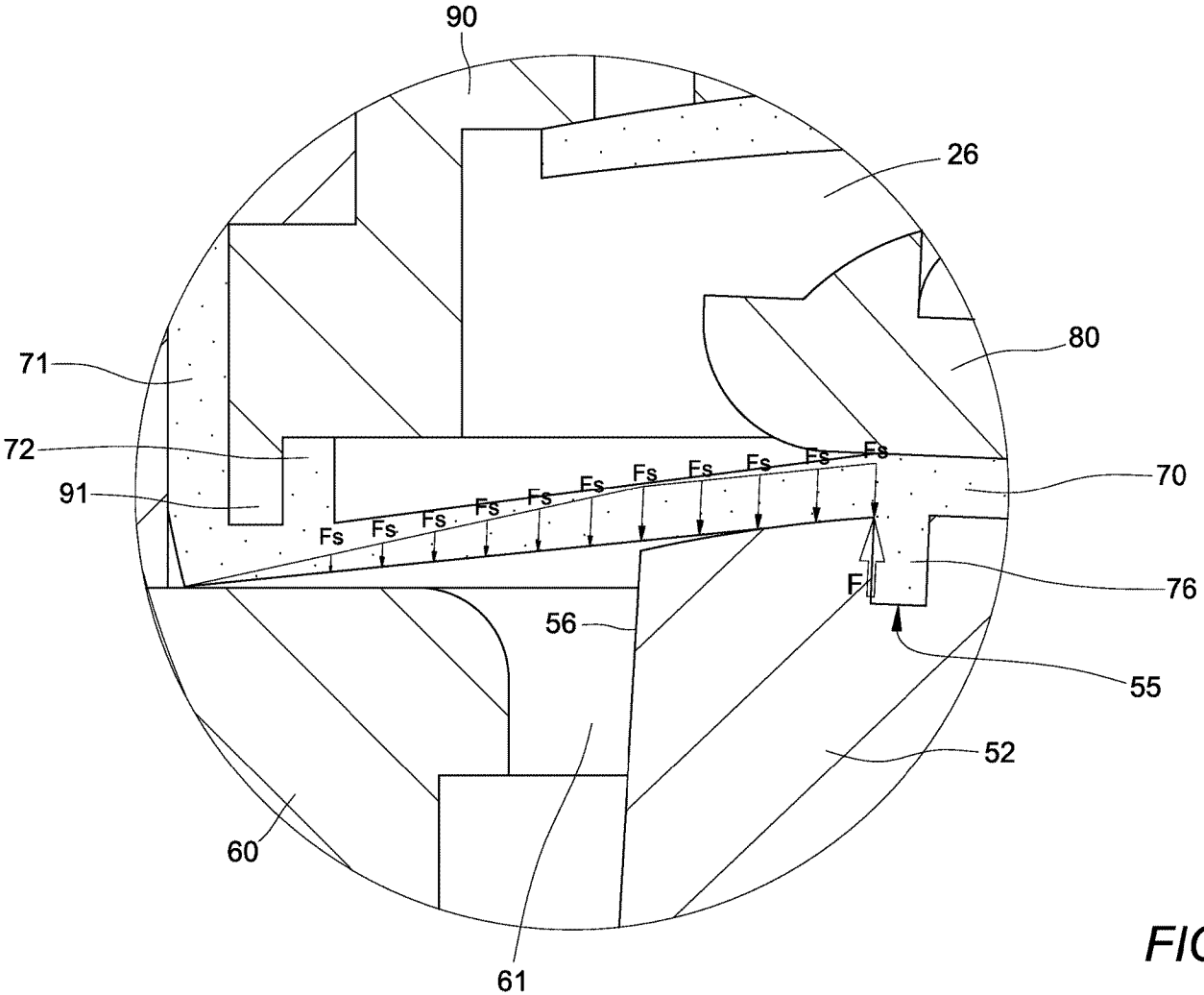
FIG. 20 is a partially enlarged view taken from circled-portion-a of previous FIG. 19.
Figure 21:
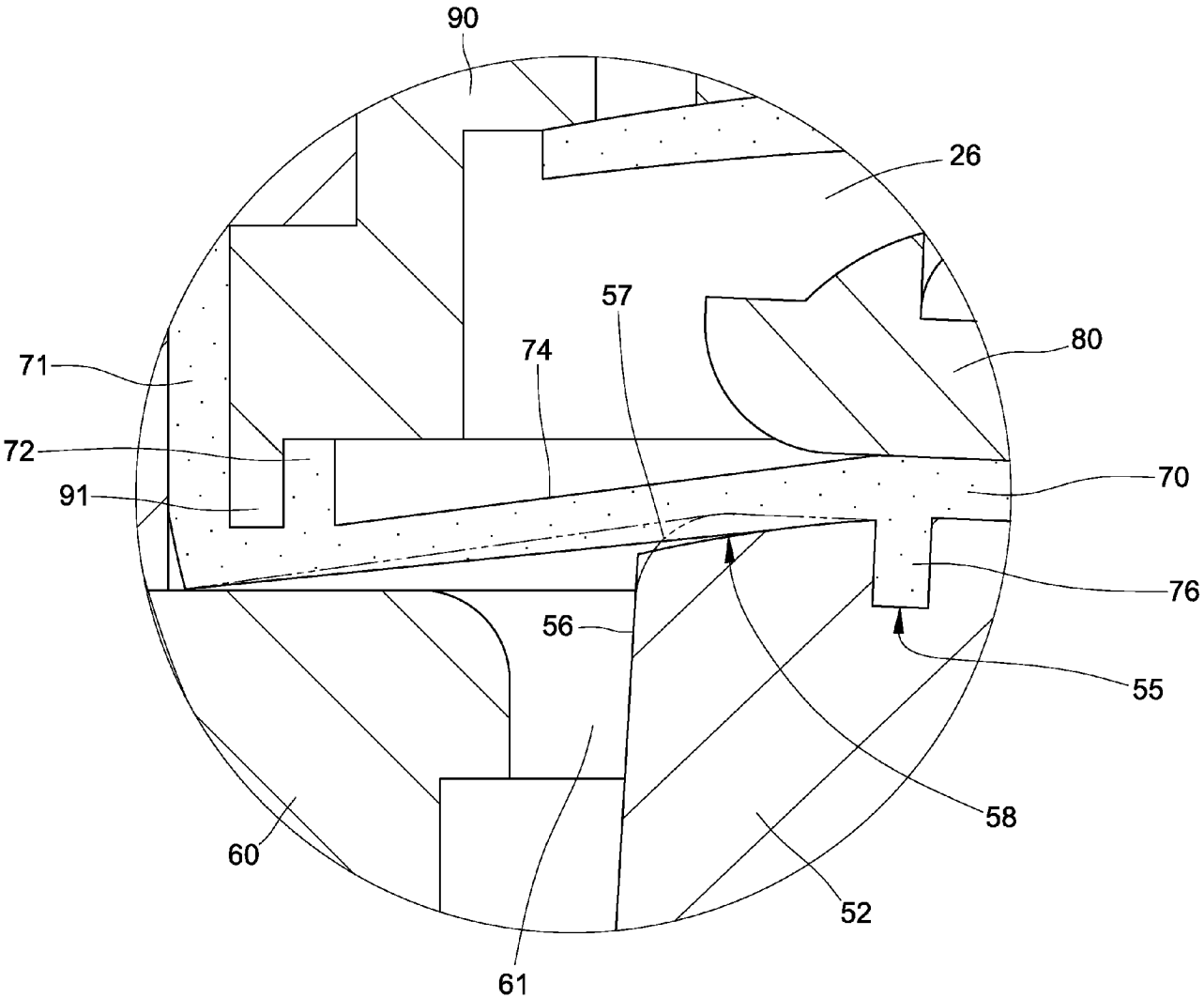
FIG. 21 is an illustrative view showing the contrastive comparison of the correspondent eccentric roundels respectively acting with the diaphragm membrane for an essential configuration of the conventional four-booster-chamber diaphragm pump and an essential configuration in the first exemplary embodiment of the present invention.

Please refer to FIGS. 19 through 21, which are illustrative figures for the operation of the "eccentric roundel structure for four-booster-chamber diaphragm pump" in an essential configuration for the first exemplary embodiment of the present invention. When the motor 10 is powered on, the wobble plate 40 is driven to rotate by the motor output shaft 11 so that four truncated-cylinder eccentric roundel 52 on the eccentric roundel mount 50 orderly move in up-and-down reciprocal stroke constantly, then four piston acting zones 74 in the diaphragm membrane 70 are orderly driven by the up-and-down reciprocal stroke of four truncated-cylinder eccentric roundel 52 to move in up-and-down displacement. When the truncated-cylinder eccentric roundel 52 moves in "up stroke" with piston acting zone 74 in up displacement, an acting force F will obliquely pull the partial portion between corresponding annular positioning protrusion 76 and outer raised brim 71 of the diaphragm membrane 70.

Figure 14:
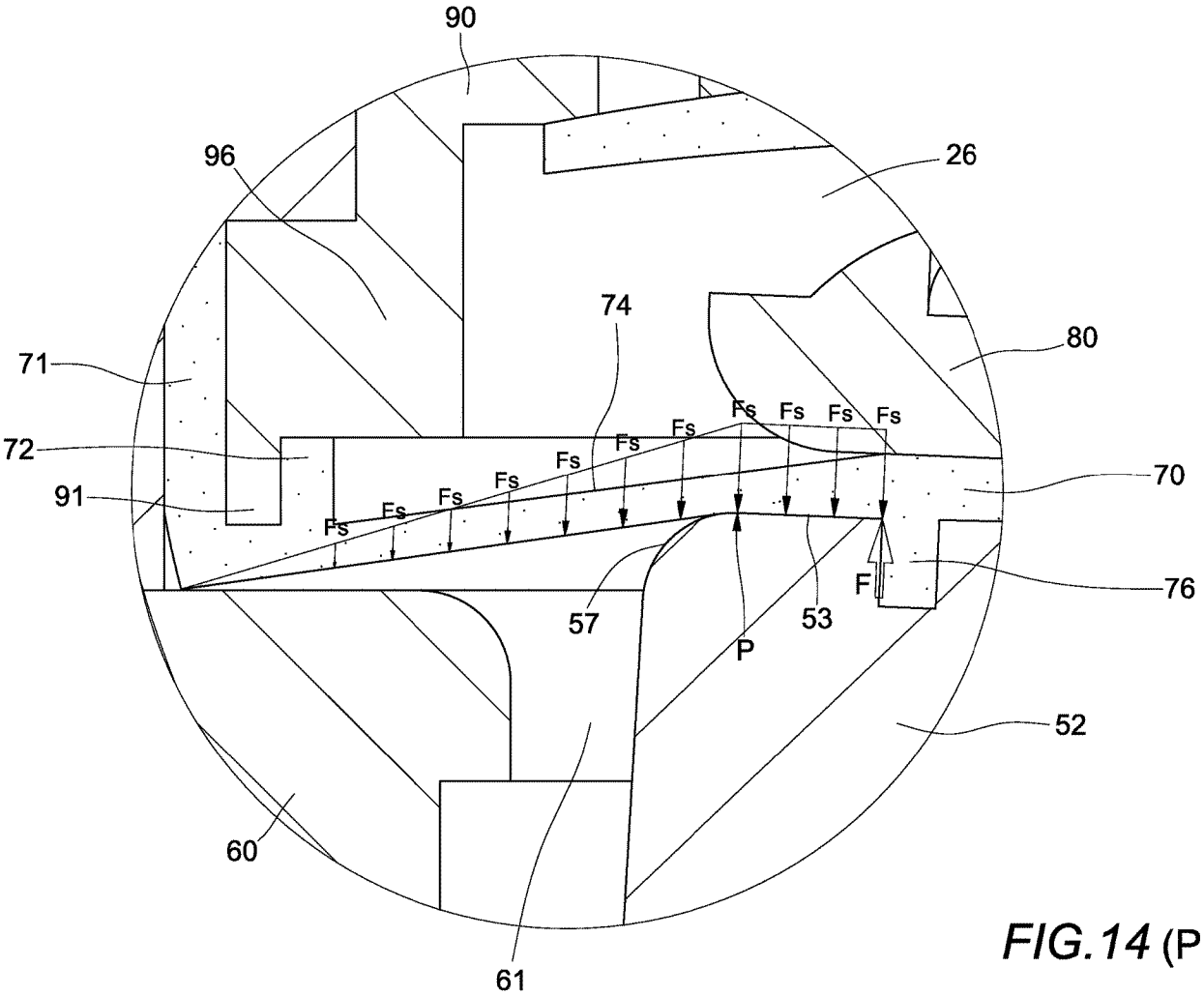
FIG. 14 (PRIOR ART)
FIG. 14 is a partially enlarged view taken from circled-portion-a of previous FIG. 13.
Figure 15:
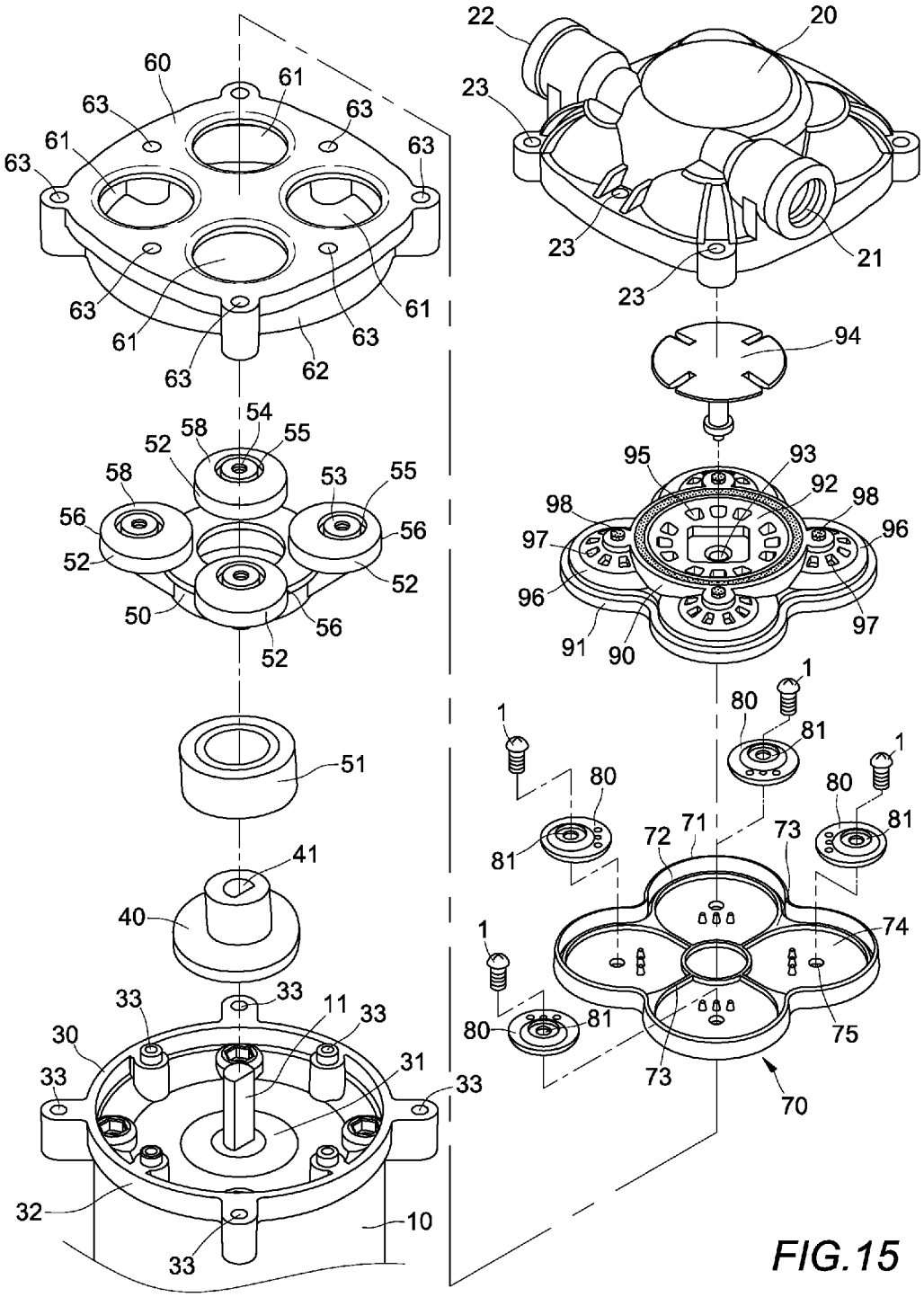
FIG. 15 is a perspective exploded view in the first exemplary embodiment for an eccentric roundel structure of the present invention installed in the essential configuration of a conventional four-booster-chamber diaphragm pump.

Please refer to FIGS. 14 and 20. By comparing to the operations between the conventional truncated-cylinder eccentric roundel 52 and that of the present invention, at least two differences are obtained as below. In the case of conventional truncated-cylinder eccentric roundel 52, among all distributed components of the rebounding force Fs, the component force happened at the contacting bottom position P of the diaphragm membrane 70 with the rounded shoulder 57 of the horizontal top face 53 in the truncated-cylinder eccentric roundel 52 is maximum so that the "squeezing phenomenon" happened here is also maximum (as shown in FIG. 14). With such nonlinear distribution of the "squeezing phenomena", the obliquely pulling action becomes severe. Whereas, in the case of truncated-cylinder eccentric roundel 52 of the present invention, all distributed components of the rebounding force Fs seem rather linear because the sloped top rim 58 therein flatly attaches the bottom area of the piston acting zone 74 for the diaphragm membrane 70 so that the obliquely pulling action almost eliminated due to no "squeezing phenomenon" (as shown in FIG. 20 and enlarged view a of association). Moreover, under the same acting force F, the rebounding force Fs is inversely proportional to the contact area so that all distributed components of the rebounding force Fs for the truncated-cylinder eccentric roundel 52 of the present invention (as shown in FIG. 20) are substantially less than all distributed components of the rebounding force Fs for the conventional truncated-cylinder eccentric roundel 52 (as shown in FIG. 14). From above comparison, two advantages are inherited by means of the sloped top rim 58 created from the annular positioning dent 55 to the truncated cylinder peripheral 56 in the eccentric roundel mount 50. First, the susceptible breakage of the diaphragm membrane 70 caused by the "squeezing phenomena" of high frequency, which is incurred by the rounded shoulder 57 of the horizontal top face 53 in the truncated-cylinder eccentric roundel 52, is completely eliminated(as associated hypothetic portion shown in FIG. 21). Second, the rebounding force Fs of the diaphragm membrane 70 caused by the acting force F, which is incurred by the orderly up-and-down displacement of four piston acting zones 74 in the diaphragm membrane 70 driven by the up-and-down reciprocal stroke of four truncated-cylinder eccentric roundel 52, is tremendously reduced. Therefore, from above inherited advantages, some benefits are obtained as below. The durability of the diaphragm membrane 70 for sustaining the pumping action of high frequency from the truncated-cylinder eccentric roundel 52 is mainly enhanced, the power consumption of the four-booster-chamber diaphragm pump is tremendously diminished due to less current being wasted in the "squeezing phenomena" of high frequency, the working temperature of the four-booster-chamber diaphragm pump is tremendously subdued due to less power consumption being used, and the annoying noise of the bearing incurred by the aged lubricant in the four-booster-chamber diaphragm pump, which is expeditiously accelerated by the high working temperature, is mostly eliminated. Moreover, through practical pilot test for the sample of the present invention, the testing results are shown as below. The service lifespan of the diaphragm membrane 70 is exceedingly extended over double, the diminished electric current is over 1 ampere, the subdued working temperature is over 15 degree of Celsius, and the smoothness of the bearing is better improved.

Figure 22:
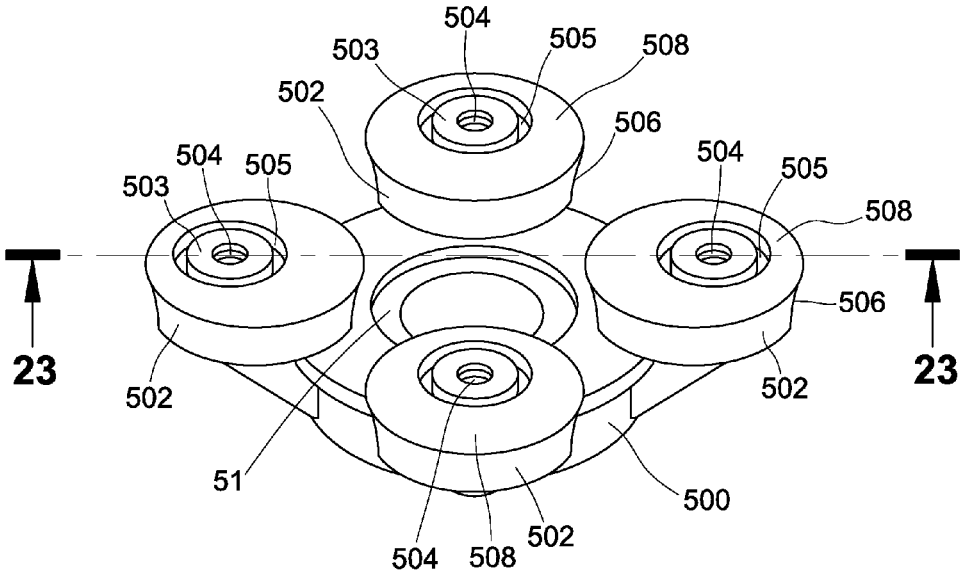
FIG. 22 is a perspective view for eccentric roundel mount of an essential configuration in the second exemplary embodiment of the present invention.
Figure 23:
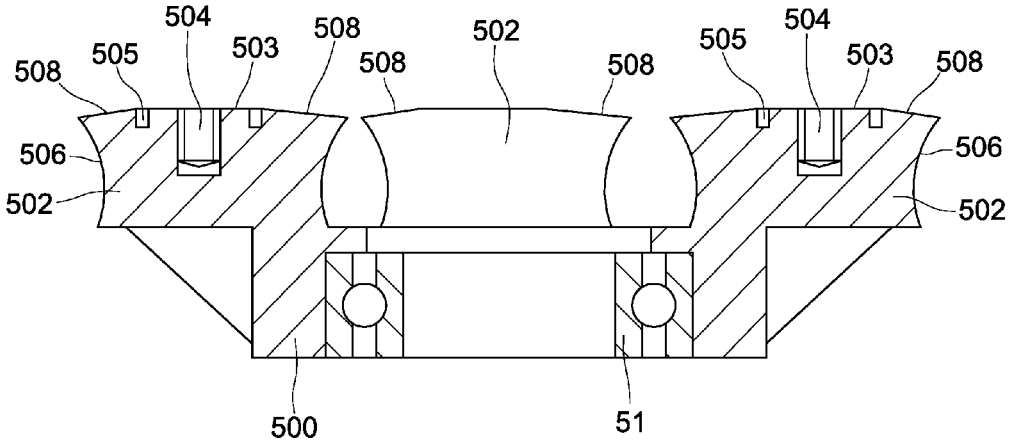
FIG. 23 is a cross sectional view taken against the section line of 23-23 from previous FIG. 22.
Figure 24:
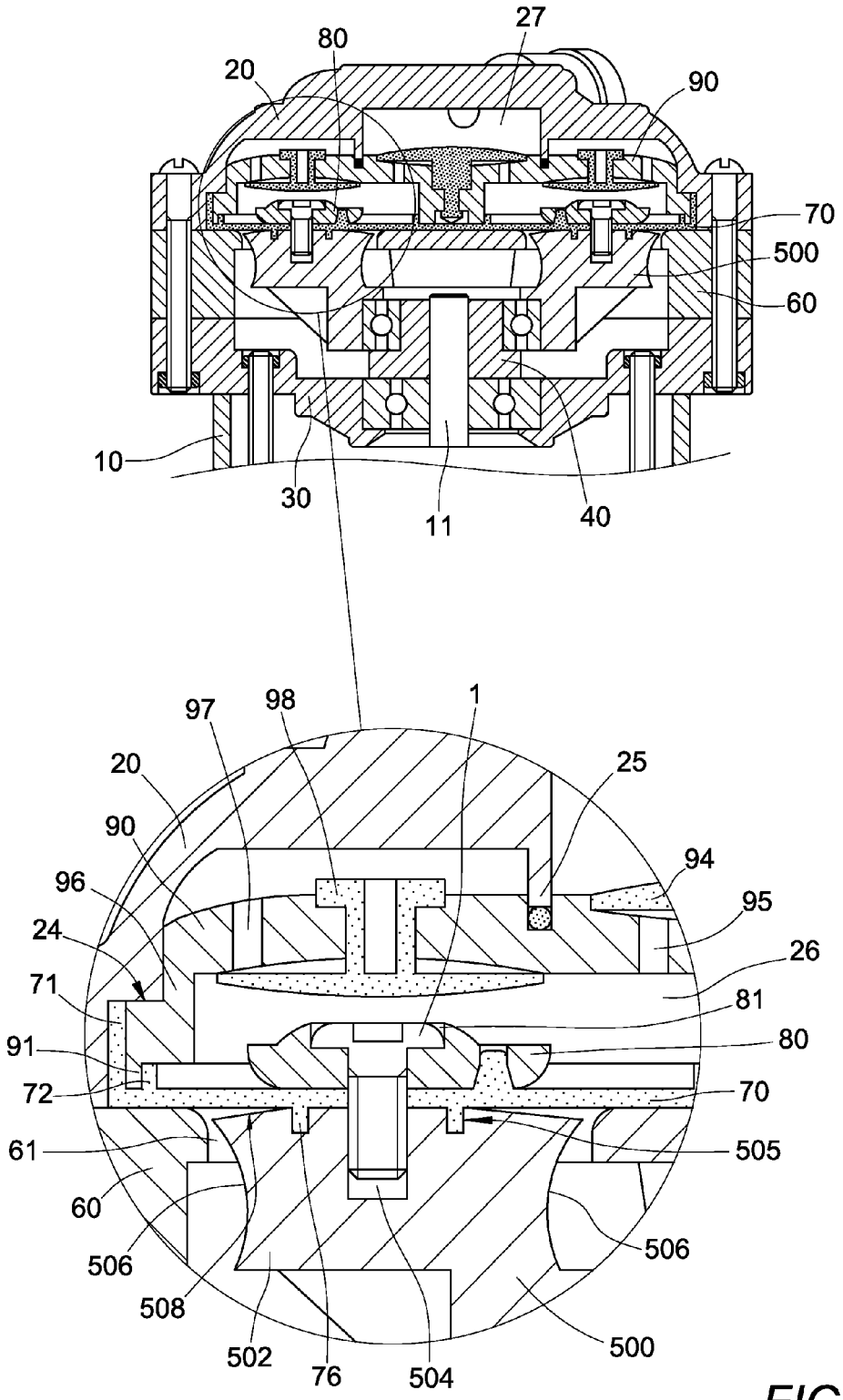
FIG. 24 is a partial cross sectional view in the second exemplary embodiment for an eccentric roundel structure in an essential configuration of the present invention installed in an essential configuration of the conventional four-booster-chamber diaphragm pump.

Please refer to FIGS. 22 through 24, which are illustrative figures of "eccentric roundel structure for four-booster-chamber diaphragm pump" in an essential configuration for the second exemplary embodiment of the present invention such that each of the four eccentric roundel structures is an inwardly meniscus truncated cylinder eccentric roundel 502 in an eccentric roundel mount 500. Wherein, the inwardly meniscus truncated cylinder eccentric roundel 502 basically comprises a horizontal top rim 503, a female-threaded bore 504, an annular positioning dent 505, an integral inwardly meniscus truncated cylinder peripheral 506 and a downwardly sloped meniscus rim 508 such that the outer diameter of the inwardly meniscus truncated cylinder eccentric roundel 502 is enlarged but still smaller than the inner diameter of the operating hole 61 in the pump head body 60, and the downwardly sloped meniscus rim 508 is created from the annular positioning dent 505 to the inwardly meniscus truncated cylinder peripheral 506.

Figure 25:
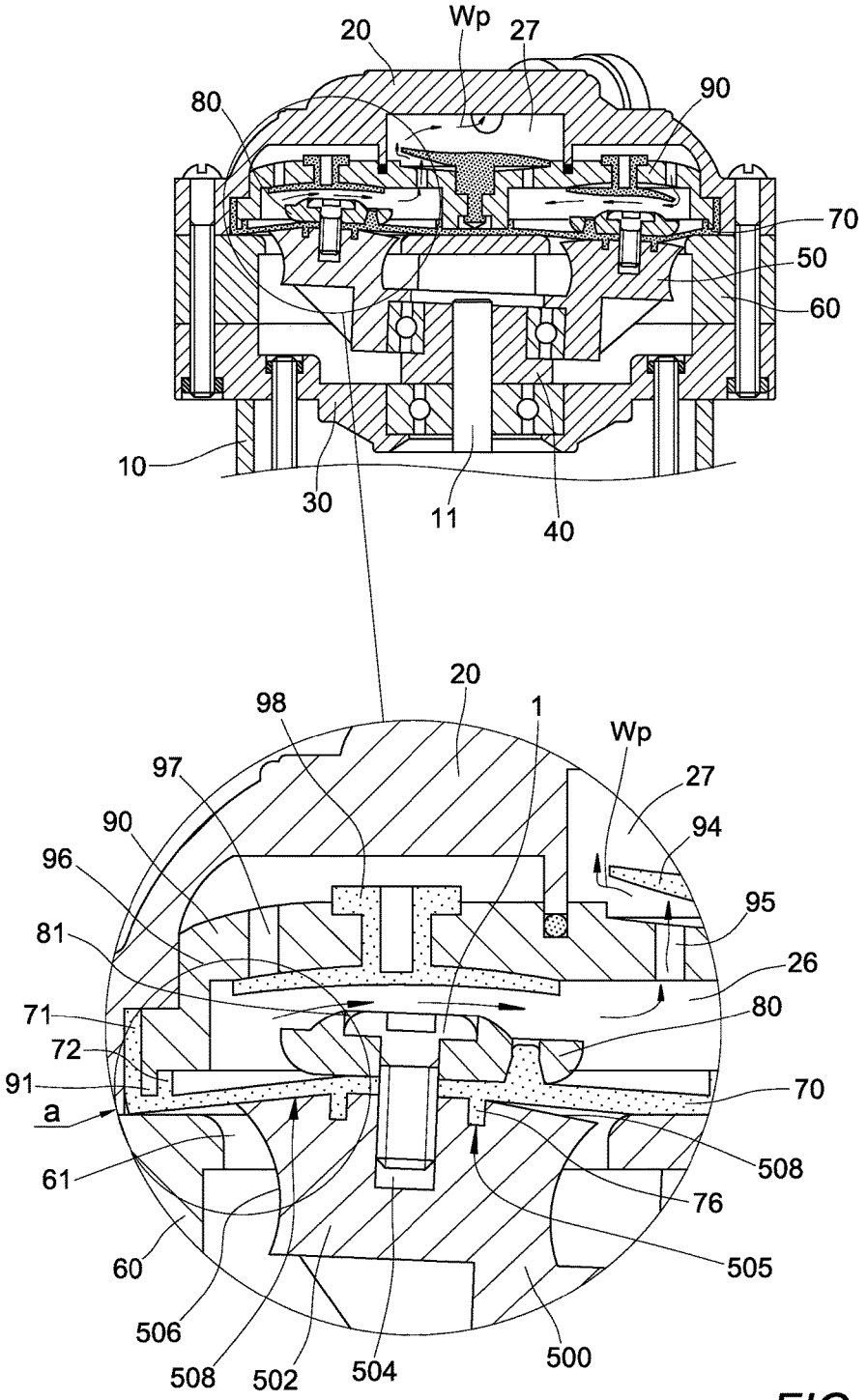
FIG. 25 is an operation illustrative view for an essential configuration in the second exemplary embodiment of the present invention.
Figure 26:
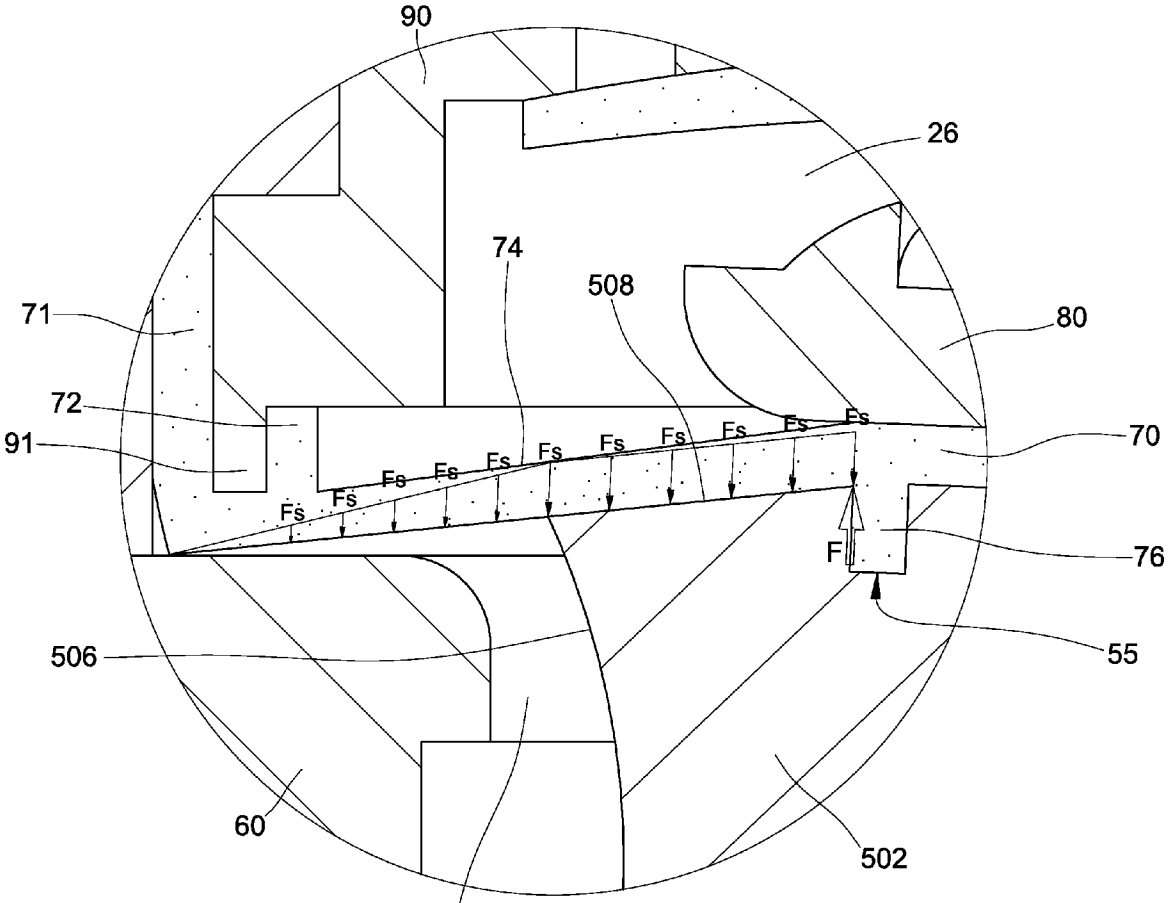
FIG. 26 is a partially enlarged view taken from circled-portion-a of previous FIG. 25.
Figure 27:
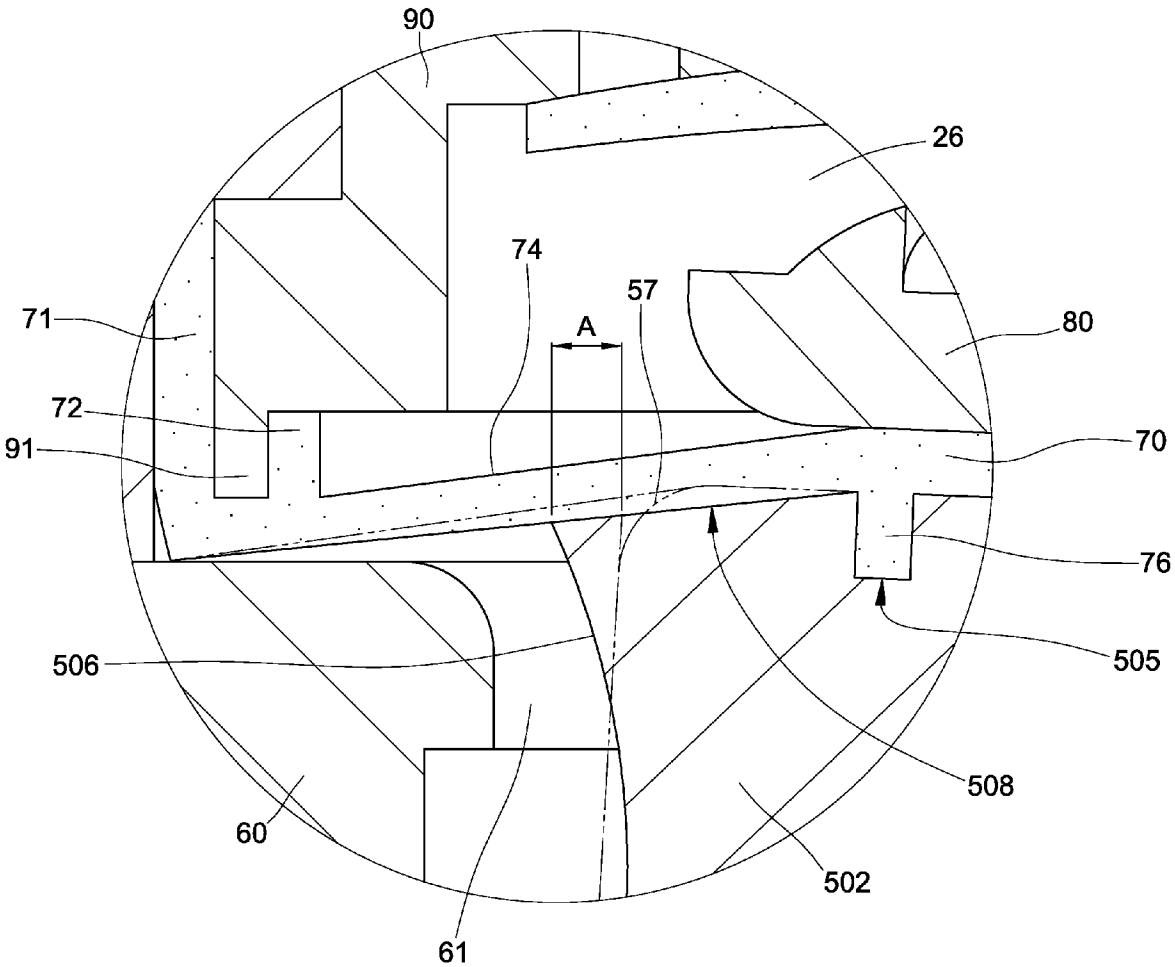
FIG. 27 is an illustrative view showing the contrastive comparison of the correspondent eccentric roundels respectively acting the diaphragm membrane for an essential configuration of the conventional four-booster-chamber diaphragm pump and an essential configuration in the second exemplary embodiment of the present invention.

Please refer to FIGS. 25 through 27, which are illustrative figures for the operation of the "eccentric roundel structure for four-booster-chamber diaphragm pump" in an essential configuration for the second exemplary embodiment of the present invention. When the motor 10 is powered on, the wobble plate 40 is driven to rotate by the motor output shaft 11 so that four inwardly meniscus truncated cylinder eccentric roundel 502 on the eccentric roundel mount 500 orderly move in up-and-down reciprocal stroke constantly, meanwhile four piston acting zones 74 in the diaphragm membrane 70 are orderly driven by the up-and-down reciprocal stroke of four inwardly meniscus truncated cylinder eccentric roundel 502 to move in up-and-down displacement. When the inwardly meniscus truncated cylinder eccentric roundel 502 in the present invention moves in "up stroke" with piston acting zone 74 in up displacement, an acting force F will obliquely pull the partial portion between corresponding annular positioning protrusion 76 and outer raised brim 71 of the diaphragm membrane 70 so that by means of the downwardly sloped meniscus rim 508 in the eccentric roundel mount 500, not only the susceptible breakage of the diaphragm membrane 70 caused by the "squeezing phenomena" of high frequency is completely eliminated but also the rebounding force Fs of the diaphragm membrane 70 caused by the acting force F is tremendously reduced. Meanwhile, by means of the inwardly meniscus truncated cylinder peripheral 506, the colliding possibility the inwardly meniscus truncated cylinder eccentric roundel 502 with the operating hole 61 in the pump head body 60 is eliminated even the outer diameter of the inwardly meniscus truncated cylinder eccentric roundel 502 is enlarged (as shown in FIGS. 25 and 26). Moreover, under the same acting force F, the rebounding force Fs is inversely proportional to the contact area. By means of the enlarged outer diameter of the inwardly meniscus truncated cylinder eccentric roundel 502, the contact area of the downwardly sloped meniscus rim 508 with the bottom side of the diaphragm membrane 70 is increased so that all distributed components of the rebounding force Fs for the inwardly meniscus truncated cylinder eccentric roundel 502 of the present invention are further reduced (as distributed variety of Fs shown in FIG. 26). Therefore, by means of the inwardly meniscus truncated cylinder eccentric roundel 502 in the present invention, some benefits are obtained as below. The durability of the diaphragm membrane 70 for sustaining the pumping action of high frequency from the inwardly meniscus truncated cylinder eccentric roundel 502 is enhanced, the power consumption of the four-booster-chamber diaphragm pump is tremendously diminished due to less current being wasted in the "squeezing phenomena" of high frequency (as associated hypothetic portion shown in FIG. 27), the working temperature of the four-booster-chamber diaphragm pump is tremendously subdued due to less power consumption being used, the annoying noise of the bearing incurred by the aged lubricant in the compressing diaphragm pump, which is expeditiously accelerated by the high working temperature, is mostly eliminated, and the service lifespan of the four-booster-chamber diaphragm pump is further prolonged because all distributed components of the rebounding force Fs for the inwardly meniscus truncated cylinder eccentric roundel 502 of the present invention are further reduced by means of the enlarged outer diameter of the inwardly meniscus truncated cylinder eccentric roundel 502, the contact area of the downwardly sloped meniscus rim 508 with the bottom side of the diaphragm membrane 70 is increased (as indicated by referential A shown in FIG. 27).

Figure 28:
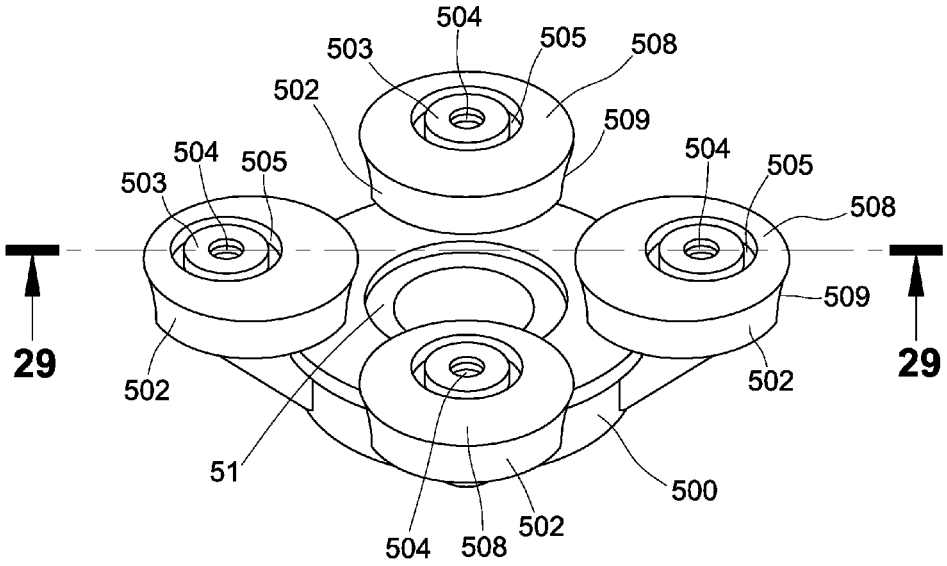
FIG. 28 is a perspective view for a modified truncated-cylinder eccentric roundels in a modified configuration for the second exemplary embodiment of the present invention.
Figure 29:
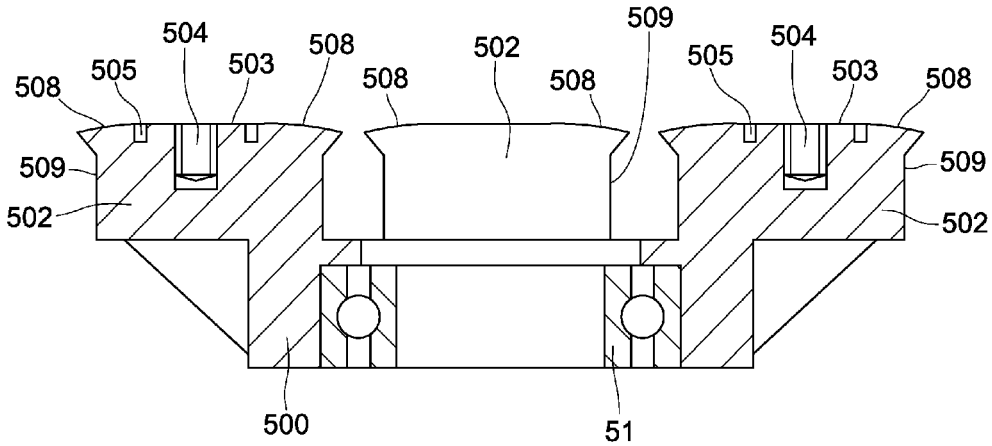
FIG. 29 is a cross sectional view taken against the section line of 29-29 from previous FIG. 28.
Figure 30:
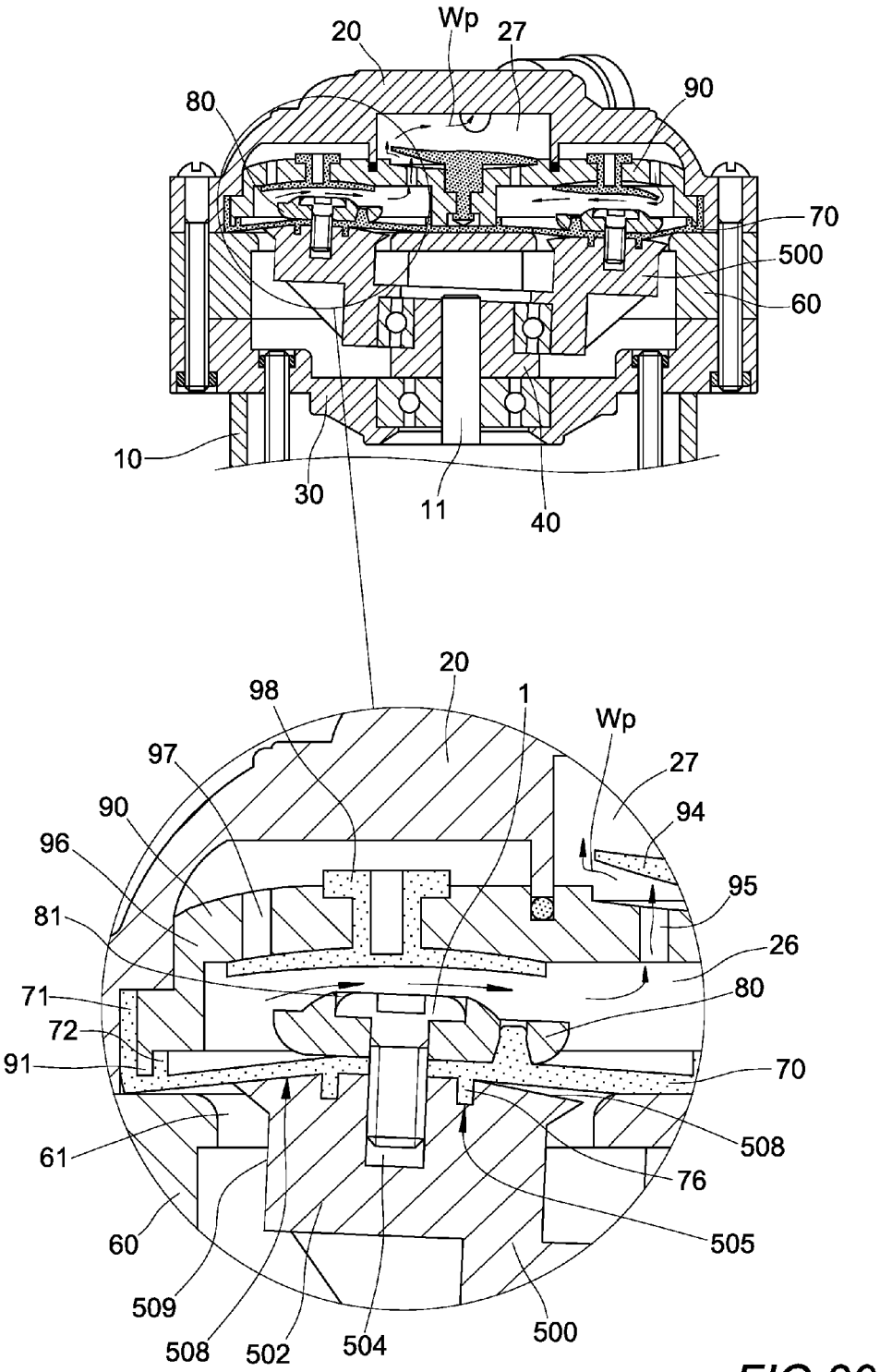
FIG. 30 is a perspective assembled view for a modified truncated-cylinder eccentric roundels in a modified configuration for the second exemplary embodiment of the present invention.
Figure 31:
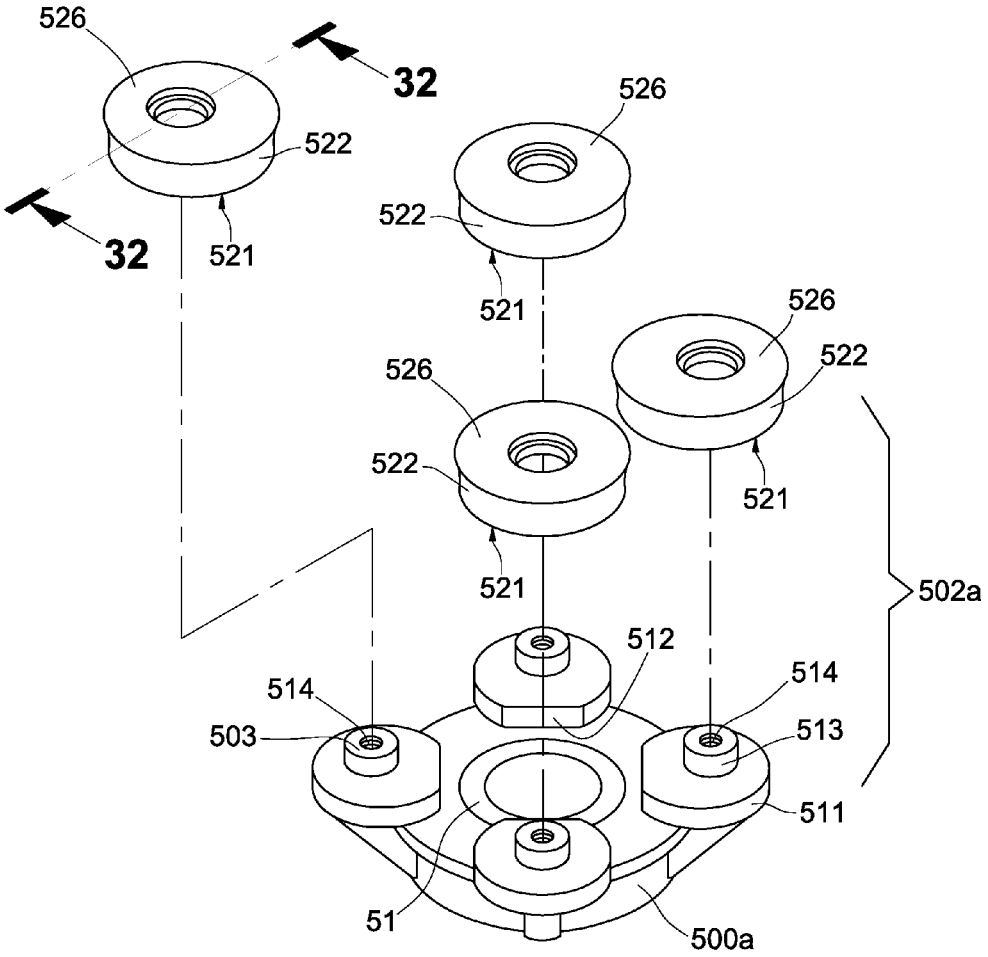
FIG. 31 is a perspective exploded view for an essential configuration of the third exemplary embodiment of the present invention.

Please refer to FIGS. 28 through 30, which are illustrative views for a modified "eccentric roundel structure for four-booster-chamber diaphragm pump" in an modified configuration for the second exemplary embodiment of the present invention such that each of the four eccentric roundel structures is a flanged eccentric roundel mount 500. Wherein, each original inwardly meniscus truncated cylinder peripheral 506 of original inwardly meniscus truncated cylinder eccentric roundel 502 in previous exemplary embodiment is modified into a flanged truncated cylinder peripheral 509 of flanged truncated cylinder eccentric roundel 502 here (as shown in FIG. 29) such that the diameter of the modified flanged truncated cylinder eccentric roundel 502 is enlarged here and larger than that of the original inwardly meniscus truncated cylinder eccentric roundel 502 but still smaller than the inner diameter for the operating hole 61 of the pump head body 60 in previous exemplary embodiment so that the colliding possibility the modified flanged truncated cylinder eccentric roundel 502 here with the operating hole 61 in the pump head body 60 is eliminated even the outer diameter thereof here is enlarged (as shown in FIG. 30).

Figure 32:
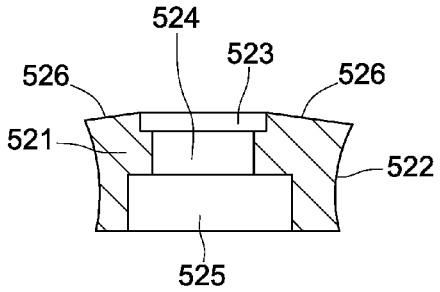
FIG. 32 is a cross sectional view taken against the section line of 32-32 from previous FIG. 31.
Figure 33:
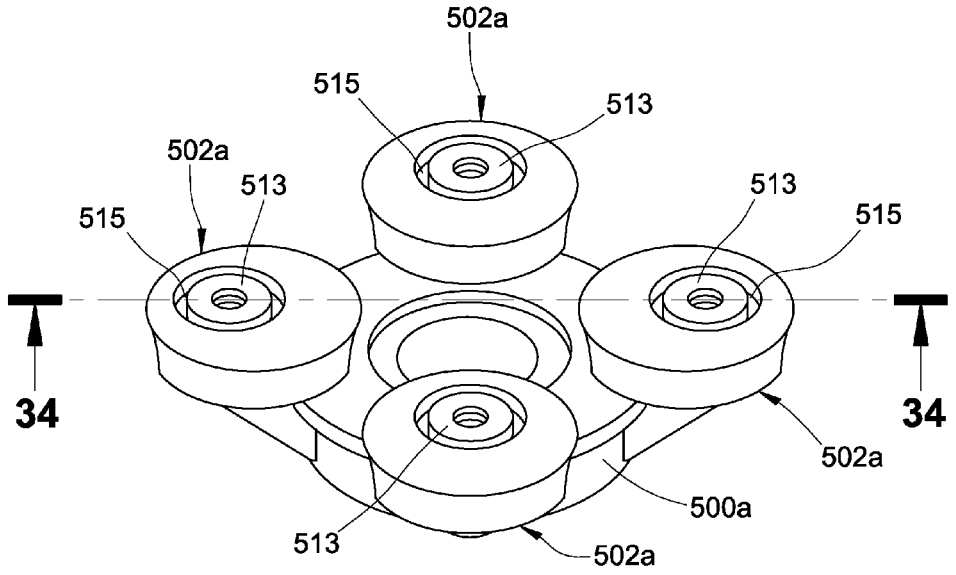
FIG. 33 is a perspective assembled view for an essential configuration in the third exemplary embodiment of the present invention.
Figure 34:
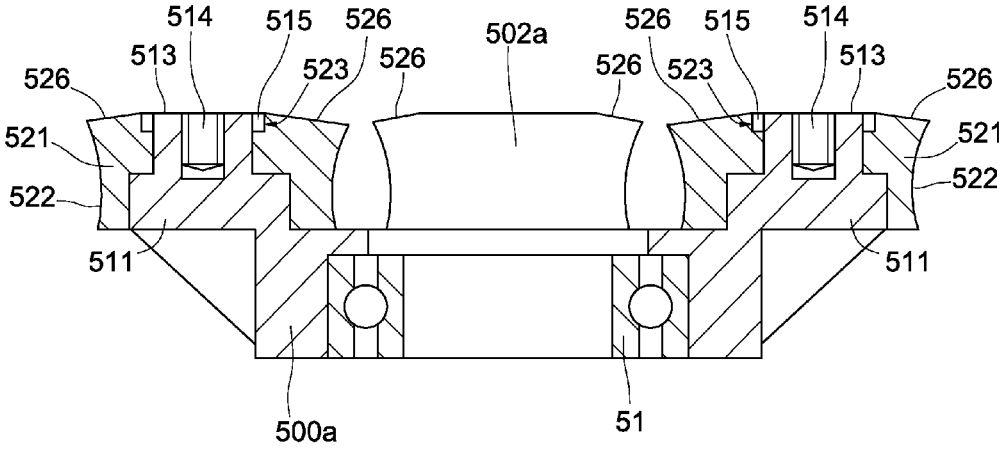
FIG. 34 is a cross sectional view taken against the section line of 34-34 from previous FIG. 33.

Please refer to FIGS. 31 through 34, which are illustrative figures of "eccentric roundel structure for four-booster-chamber diaphragm pump" in an essential configuration for the third exemplary embodiment of the present invention such that each of the four eccentric roundel structures is a combinational inwardly meniscus truncated cylinder eccentric roundel 502*a* in an eccentric roundel mount 500*a*. The combinational inwardly meniscus truncated cylinder eccentric roundel 502*a* characteristically comprises a roundel mount 511 and an inwardly meniscus truncated cylinder yoke 521 in detachable separation such that the outer diameter of the inwardly meniscus truncated cylinder yoke 521 is enlarged but still smaller than the inner diameter of the operating hole 61 in the pump head body 60, wherein said roundel mount 511, which is a two-layered frustum, includes a bottom-layer base with a positional crescent 512 facing inwardly and a top-layer protruded cylinder 513 with a central female-threaded bore 514, and said inwardly meniscus truncated cylinder yoke 521, which is to sleeve over the corresponding roundel mount 511, includes an upper bore 523, a middle bore 524 and a lower bore 525 stacked as a three-layered integral hollow frustum (as shown in FIG. 32), as well as a truncated inwardly meniscus truncated cylinder peripheral 522 and a downwardly sloped meniscus rim 526, which is created from the upper bore 523 to the truncated inwardly meniscus truncated-cylinder peripheral 522 such that the bore diameter of the upper bore 523 is bigger than the outer diameter of the protruded cylinder 513, the bore diameter of the middle bore 524 is equivalent to the outer diameter of the protruded cylinder 513 while the bore diameter of the lower bore 525 is equivalent to the outer diameter of the bottom-layer base in the roundel mount 511, and a circumstantial positioning dented ring 515 created between the outer wall of the protruded cylinder 513 and the inside wall of the upper bore 523 upon having the inwardly meniscus truncated cylinder yoke 521 sleeved over the roundel mounts 511 (as shown in FIGS. 33 and 34).

Figure 35:
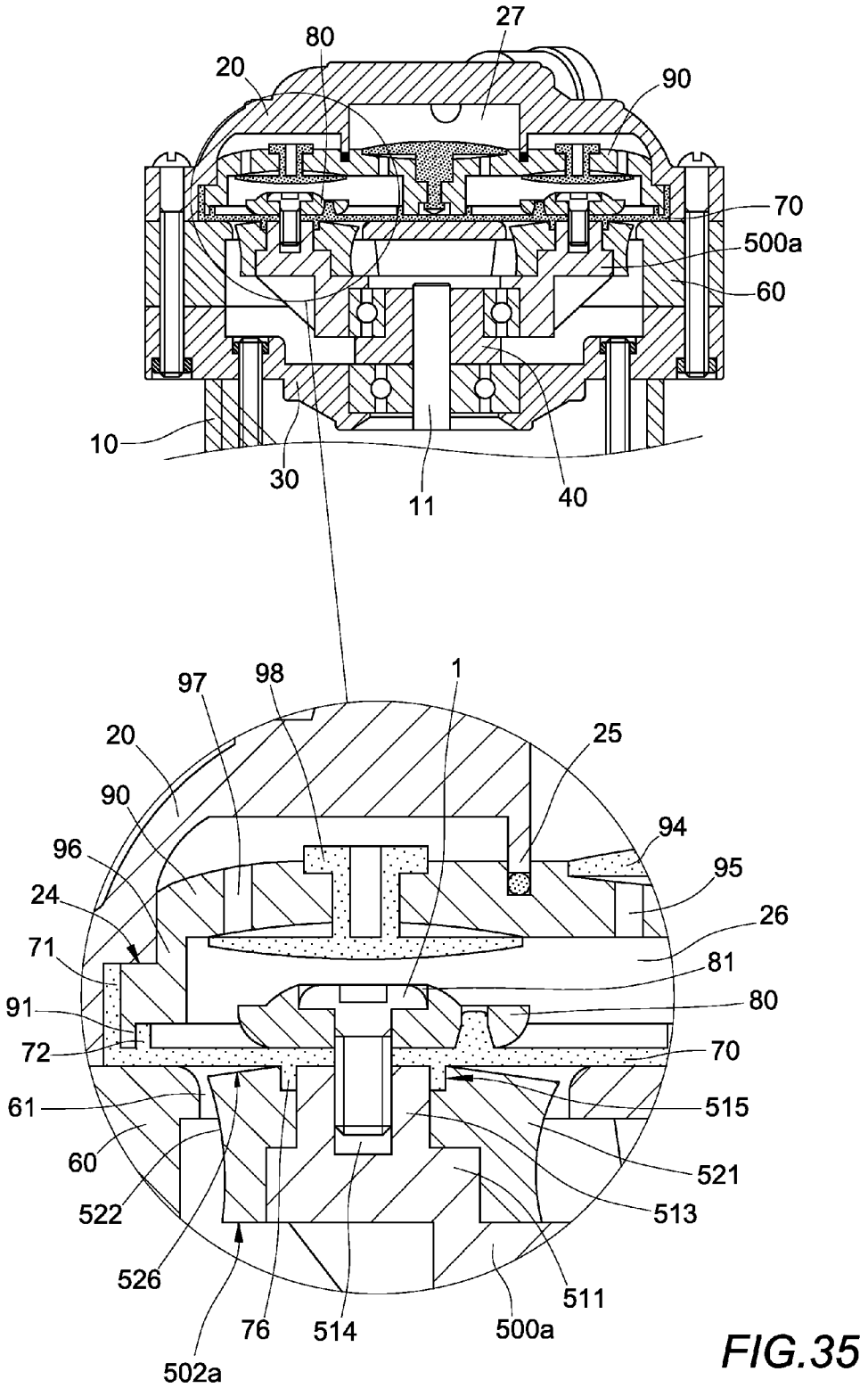
FIG. 35 is a partial cross sectional view in the third exemplary embodiment for an eccentric roundel structure in an essential configuration of the present invention installed in an essential configuration of the conventional four-booster-chamber diaphragm pump.
Figure 38:
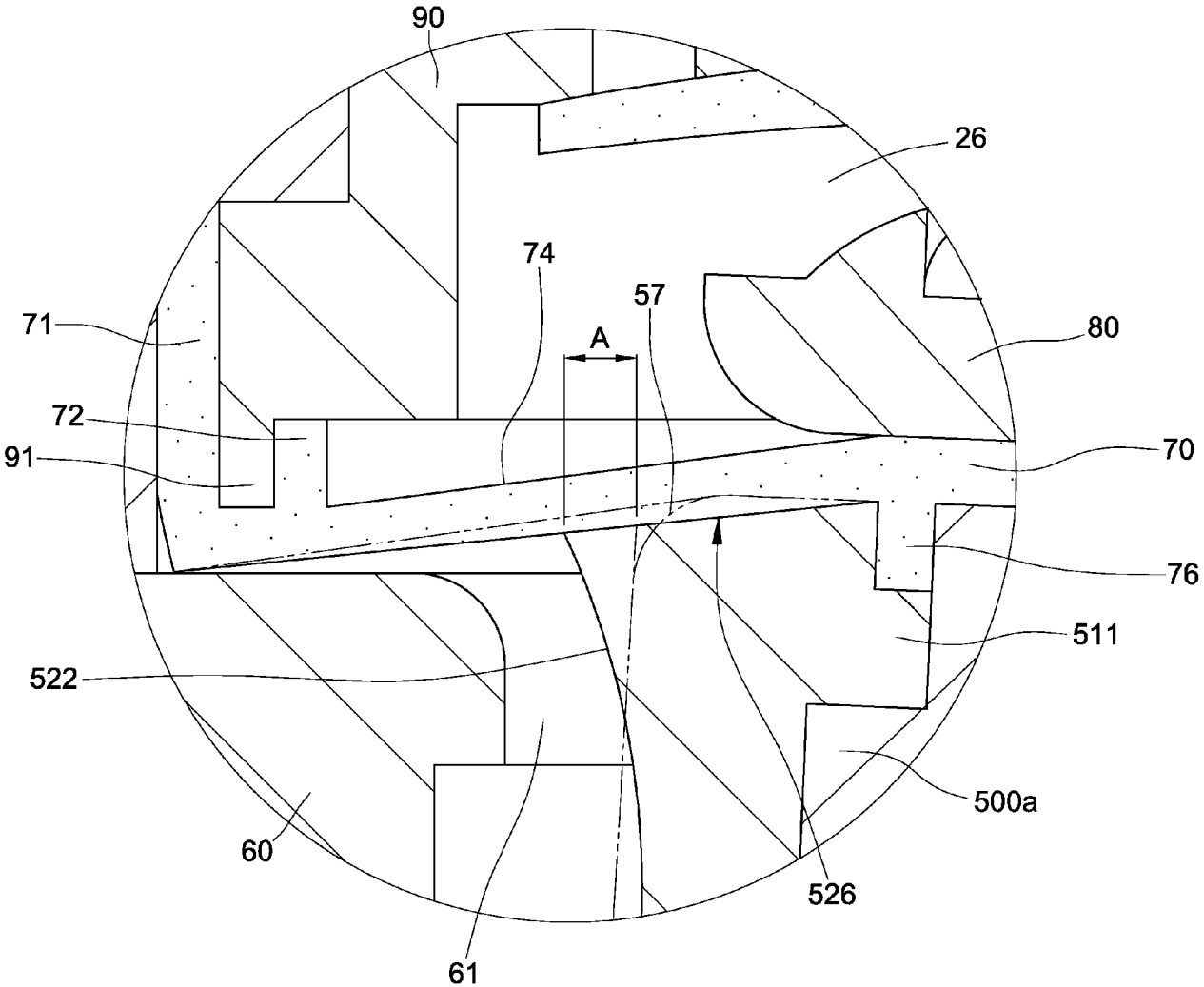
FIG. 38 is an illustrative view showing the contrastive comparison of the correspondent eccentric roundels respectively acting the diaphragm membrane for an essential configuration of the conventional four-booster-chamber diaphragm pump and an essential configuration in the third exemplary embodiment of the present invention.
Figure 39:
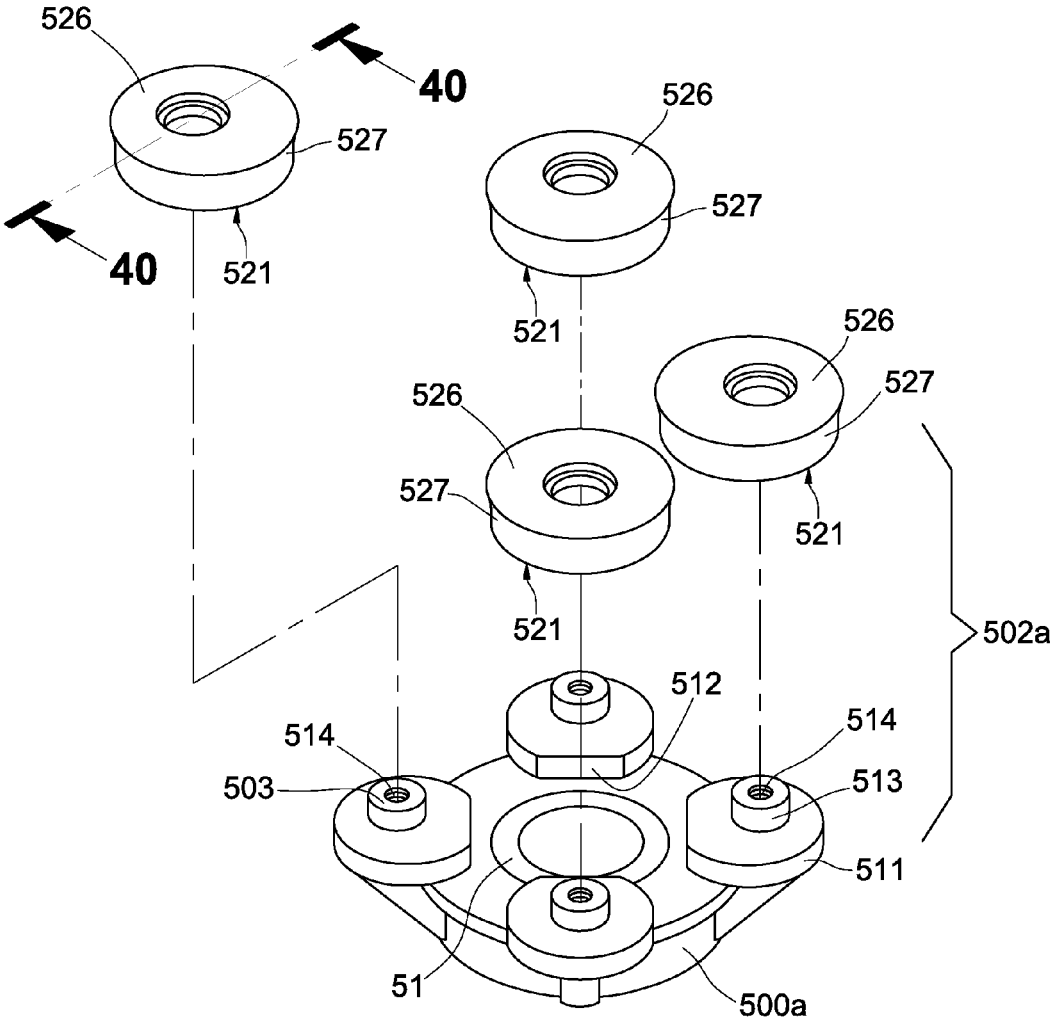
FIG. 39 is a perspective exploded view for an adapted truncated-cylinder eccentric roundel in an adapted configuration for the third exemplary embodiment of the present invention.

Please refer to FIGS. 35 and 38, which are illustrative figures for the assembly of the "eccentric roundel structure for four-booster-chamber diaphragm pump" in an essential configuration for the third exemplary embodiment of the present invention. Firstly sleeve each inwardly meniscus truncated cylinder yoke 521 over each corresponding roundel mount 511 meanwhile create a circumstantial positioning dented ring 515 for each inwardly meniscus truncated cylinder yoke 521, next insert all four annular positioning protrusions 76 of the diaphragm membrane 70 into four corresponding circumstantial positioning dented ring 515 in four combinational inwardly meniscus truncated cylinder eccentric roundel 502*a* of the eccentric roundel mount 500*a*, and then by running each fastening screw 1 through the each corresponding tiered hole 81 of pumping piston 80 and each corresponding acting zone hole 75 in each piston acting zone 74 of the diaphragm membrane 70, then securely screw the fastening screw 1 to firmly assembly the diaphragm membrane 70 and four pumping pistons 80 on four corresponding female-threaded bores 514 in four roundel mounts 511 of the eccentric roundel mount 500*a* (as enlarged view shown in FIG. 35 of association).

Figure 36:
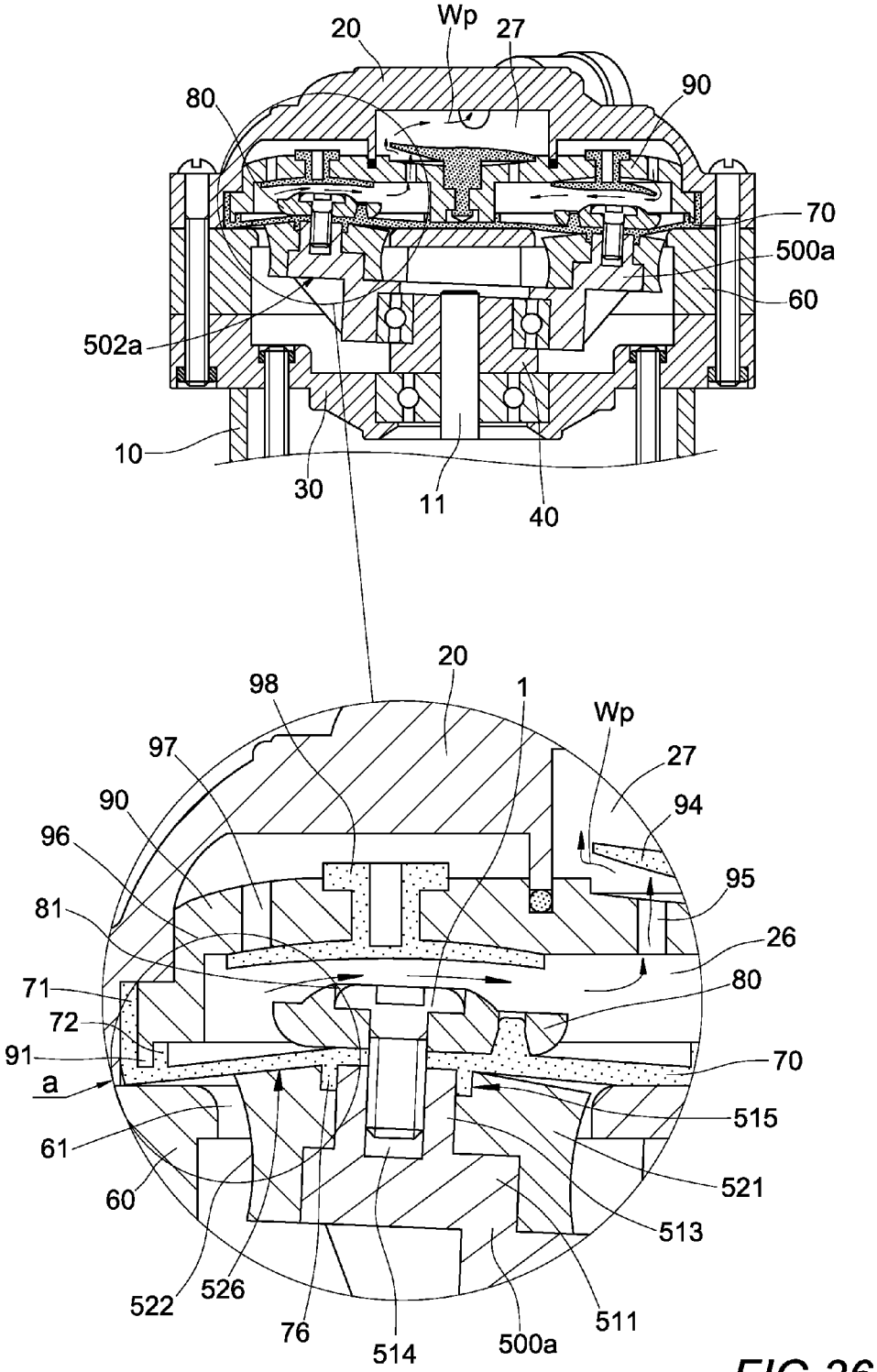
FIG. 36 is an operation illustrative view for an essential configuration in the third exemplary embodiment of the present invention.
Figure 37:
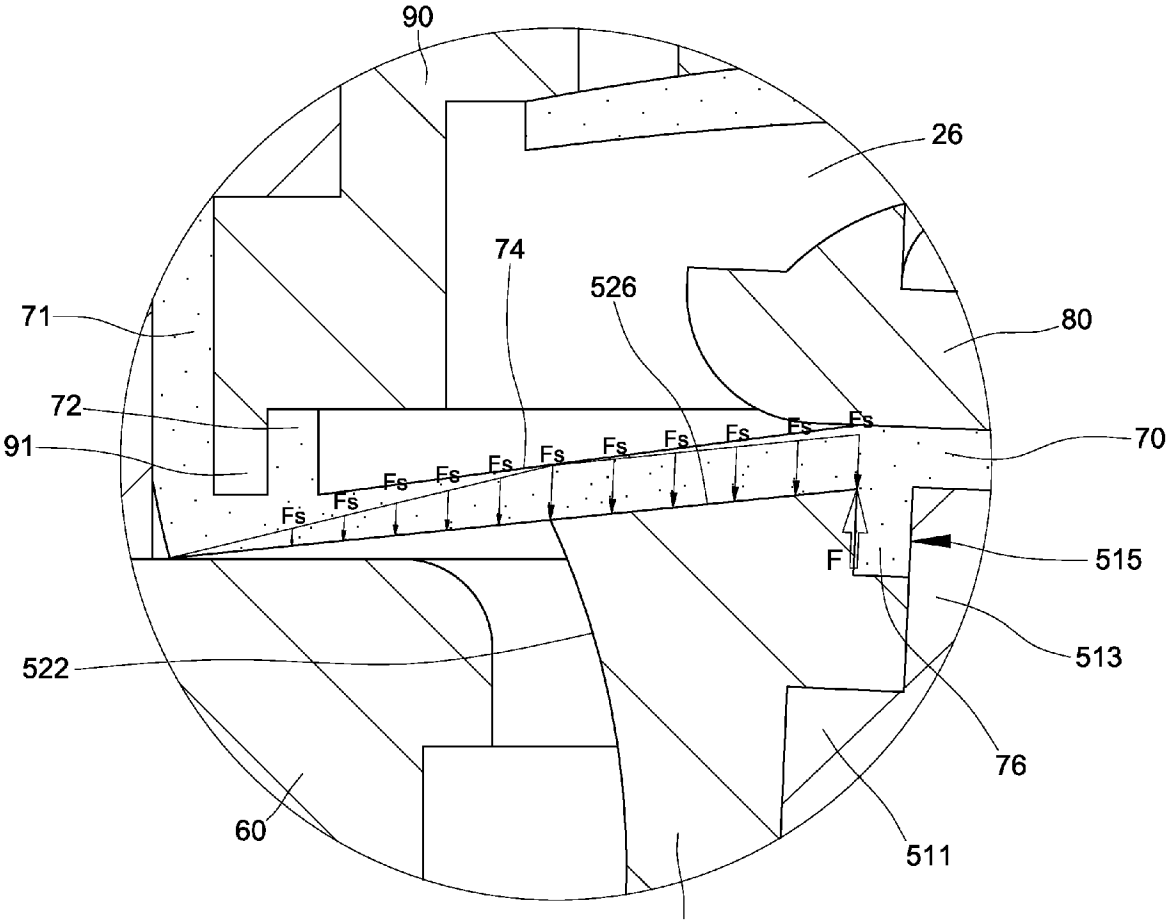
FIG. 37 is a partially enlarged view taken from circled-portion-a of previous FIG. 36.

Please refer to FIGS. 36 through 38, which are illustrative figures for the operation of the "eccentric roundel for four-booster-chamber diaphragm pump" in an essential configuration for the third exemplary embodiment of the present invention. When the motor 10 is powered on, the wobble plate 40 is driven to rotate by the motor output shaft 11 so that four combinational inwardly meniscus truncated cylinder eccentric roundel 502*a* on the eccentric roundel mount 50 orderly move in up-and-down reciprocal stroke constantly, meanwhile, four piston acting zones 74 in the diaphragm membrane 70 are orderly driven by the up-and-down reciprocal stroke of four combinational inwardly meniscus truncated cylinder eccentric roundel 502*a* to move in up-and-down displacement; When the combinational inwardly meniscus truncated cylinder eccentric roundel 502*a* in the present invention moves in "up stroke" with piston acting zone 74 in up displacement, an acting force F will obliquely pull the partial portion between corresponding annular positioning protrusion 76 and outer raised brim 71 of the diaphragm membrane 70, then by means of the downwardly sloped meniscus rim 526 in the inwardly meniscus truncated cylinder yoke 521 of the eccentric roundel mount 500*a*, not only the susceptible breakage of the diaphragm membrane 70 caused by the "squeezing phenomena" of high frequency is completely eliminated (as shown in FIGS. 36 and 37) but also the rebounding force Fs of the diaphragm membrane 70 caused by the acting force F is tremendously reduced (as enlarged view shown in FIG. 35 of association). Moreover, under the same acting force F, the rebounding force Fs is inversely proportional to the contact area (as distributed variety of Fs shown in FIG. 37). By means of the enlarged outer diameter of the inwardly meniscus truncated cylinder yoke 521, the contact area of the downwardly sloped meniscus rim 526 with the bottom side of the diaphragm membrane 70 is increased (as associated hypothetic portion shown in FIG. 38) so that all distributed components of the rebounding force Fs for the inwardly meniscus truncated cylinder yoke 521 of the present invention are further reduced.

Other than the same functions as those of the second exemplary embodiment, the fabrication of the "eccentric roundel structure for four-booster-chamber diaphragm pump" in an essential configuration for the third exemplary embodiment in the present invention is stepwise shown as below. Firstly the roundel mount 511 and eccentric roundel mount 500*a* are fabricated together as an integral body, next the inwardly meniscus truncated cylinder yoke 521 is independently fabricated as a separated entity; and then the inwardly meniscus truncated cylinder yoke 521 and the integral body of roundel mount 511 with eccentric roundel mount 500*a* are assembled to become a united entity of combinational inwardly meniscus truncated cylinder eccentric roundel 502*a*. Thereby, the contrivance of the combinational inwardly meniscus truncated cylinder eccentric roundel 502*a* not only meets the requirement of mass production but also reduces the overall manufacturing cost. Accordingly, by means of the combinational inwardly meniscus truncated cylinder eccentric roundel 502*a* with inwardly meniscus truncated cylinder yoke 521 in the present invention, some benefits are obtained as below. The durability of the diaphragm membrane 70 for sustaining the pumping action of high frequency from the inwardly meniscus truncated cylinder yoke 521 is mainly enhanced. the power consumption of the four-booster-chamber diaphragm pump is tremendously diminished due to less current being wasted in the "squeezing phenomena" of high frequency, the working temperature of the four-booster-chamber diaphragm pump is tremendously subdued due to less power consumption being used, the annoying noise of the bearing incurred by the aged lubricant in the compressing diaphragm pump, which is expeditiously accelerated by the high working temperature, is mostly eliminated, the service lifespan of the four-booster-chamber diaphragm pump is further prolonged because all distributed components of the rebounding force Fs for the inwardly meniscus truncated cylinder yoke 521 of the present invention are further reduced, and the manufacturing cost of the four-booster-chamber diaphragm pump is reduced because the present invention is suitable for mass production.

Figure 40:
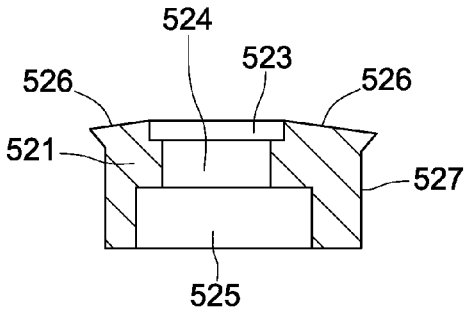
FIG. 40 is a cross sectional view taken against the section line of 40-40 from previous FIG. 39.
Figure 41:
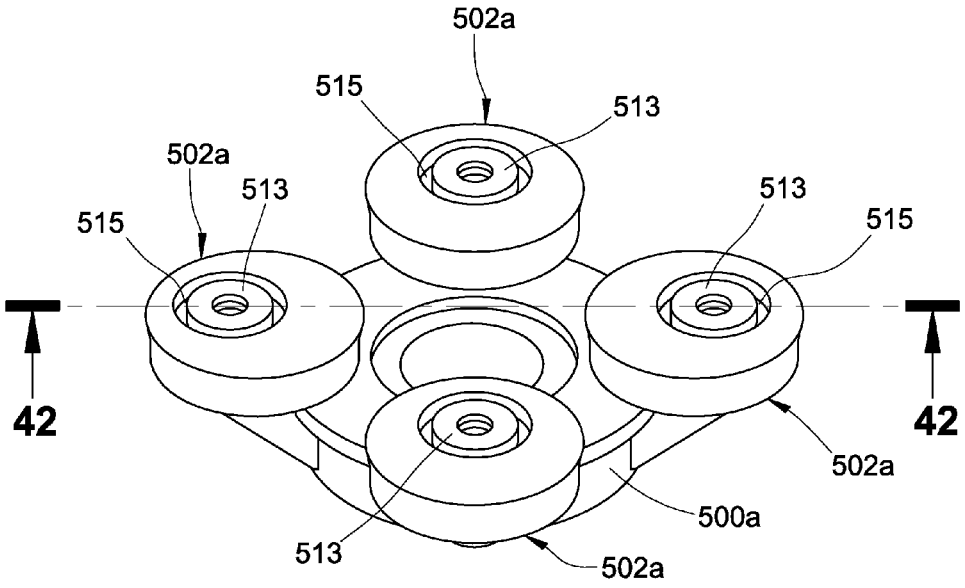
FIG. 41 is a perspective assembled view for an adapted truncated-cylinder eccentric roundel in an adapted configuration for the third exemplary embodiment of the present invention.
Figure 42:
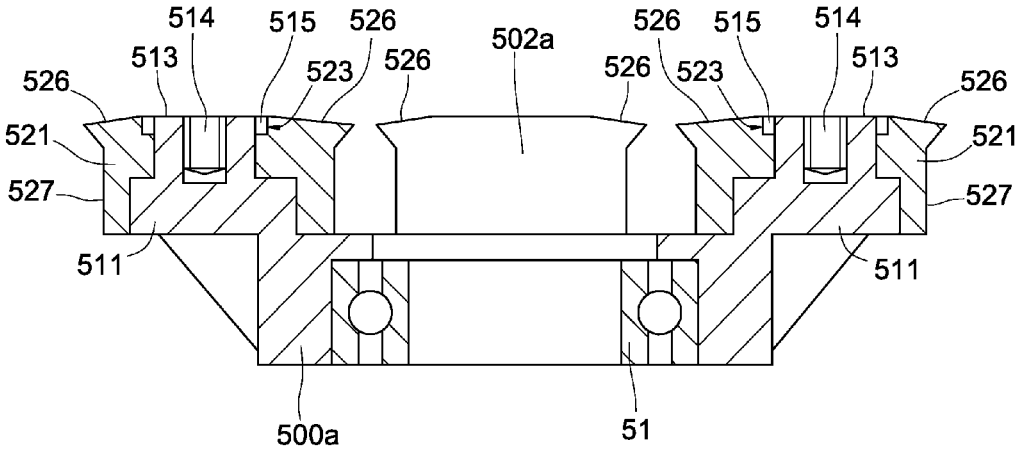
FIG. 42 is a cross sectional view taken against the section line of 42-42 from previous FIG. 41.
Figure 43:
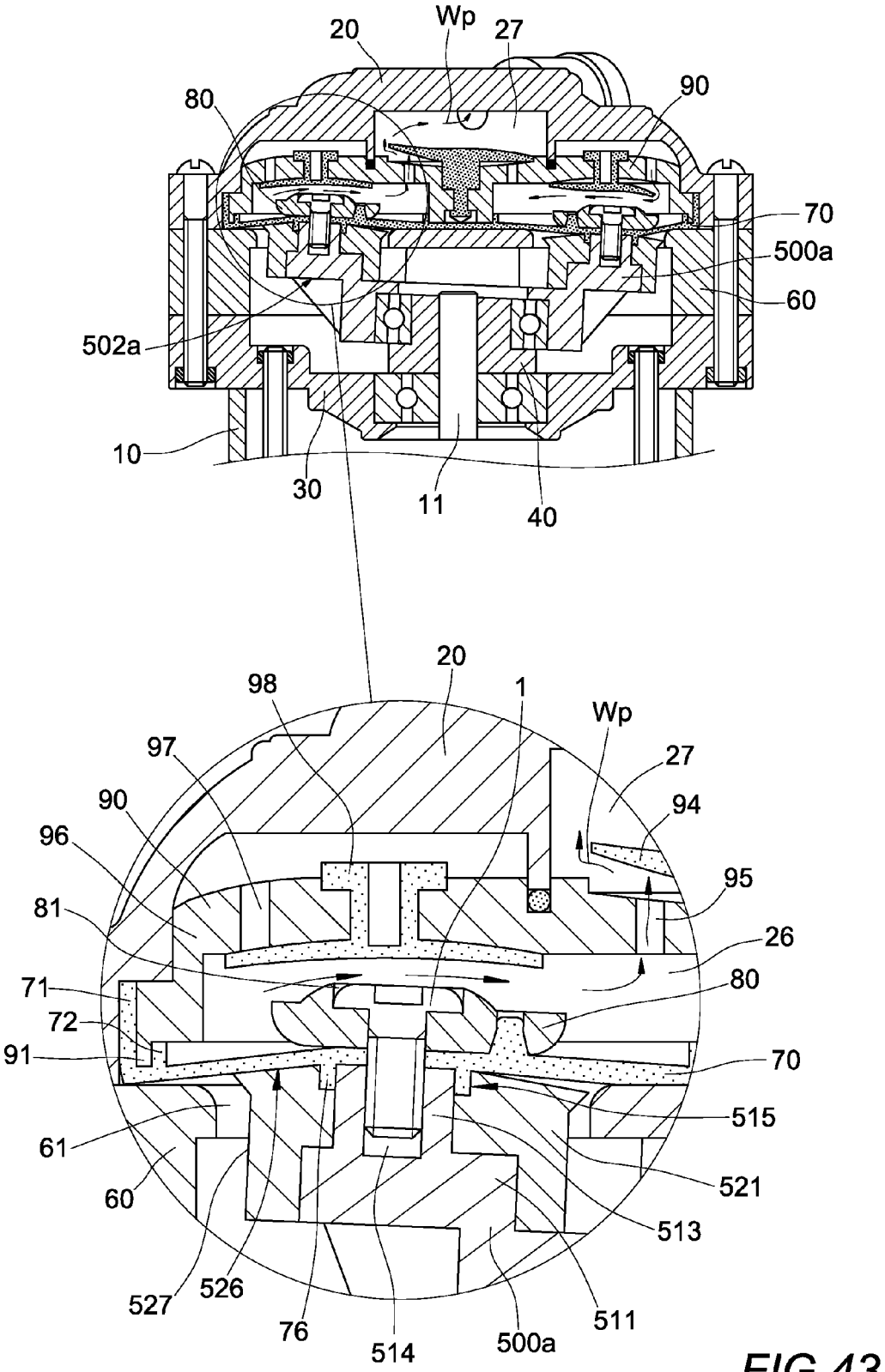
FIG. 43 is an operation illustrative view for an adapted truncated-cylinder eccentric roundel in an adapted configuration for the third exemplary embodiment of the present invention.

Please refer to FIGS. 39 through 43, which are illustrative figures for an adapted "eccentric roundel structure for four-booster-chamber diaphragm pump" in an adapted configuration for the third exemplary embodiment of the present invention such that each of the four eccentric roundel structures is a combinational flanged truncated cylinder eccentric roundel 502*a* in an eccentric roundel mount 500*a*. Wherein, each original inwardly meniscus truncated cylinder peripheral 522 of original combinational inwardly meniscus truncated cylinder eccentric roundel 502*a* in previous exemplary embodiment is adapted into a flanged truncated cylinder peripheral 527 of combinational flanged truncated cylinder eccentric roundel 502*a* here (as shown in FIG. 40) such that the diameter of the combinational flanged truncated cylinder eccentric roundel 502*a* here is enlarged and larger than that of the original combinational inwardly meniscus truncated cylinder eccentric roundel 502*a* but still smaller than the inner diameter for the operating hole 61 of the pump head body 60 in previous exemplary embodiment so that the colliding possibility the adapted combinational flanged truncated cylinder eccentric roundel 502*a* with the operating hole 61 in the pump head body 60 is eliminated even the outer diameter thereof here is enlarged (as shown in FIG. 43).

Figure 44:
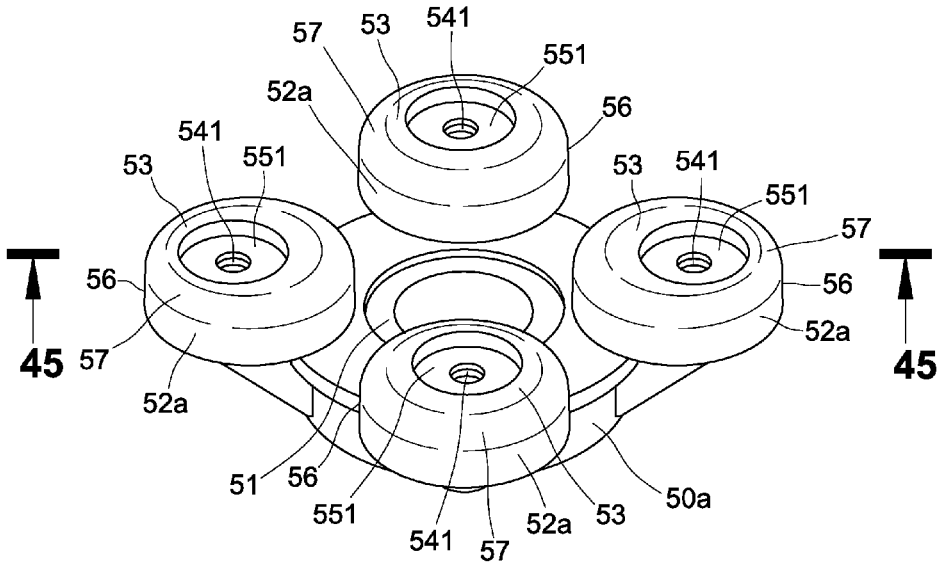
FIG. 44 is a perspective view for a changed truncated-cylinder eccentric roundel in a changed configuration of the conventional four-booster-chamber diaphragm pump.
Figure 45:
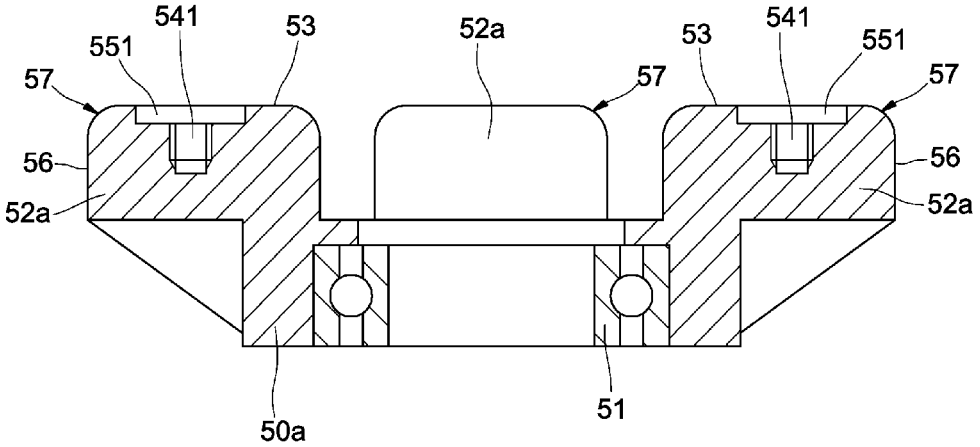
FIG. 45 is a cross sectional view taken against the section line of 45-45 from previous FIG. 44.
Figure 48:
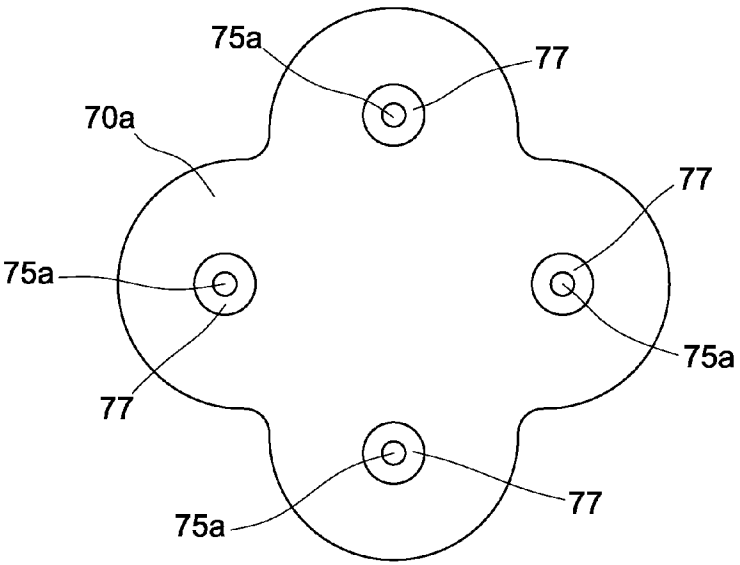
FIG. 48 is a bottom view for a changed diaphragm membrane in a changed configuration of the conventional four-booster-chamber diaphragm pump.
Figure 46:
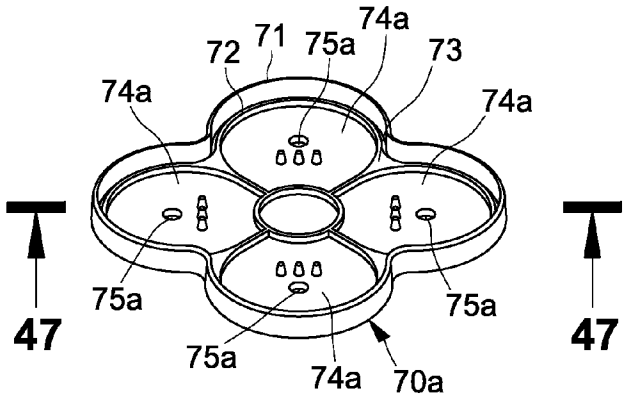
FIG. 46 is a perspective view for a changed diaphragm membrane in a changed configuration of the conventional four-booster-chamber diaphragm pump.
Figure 47:
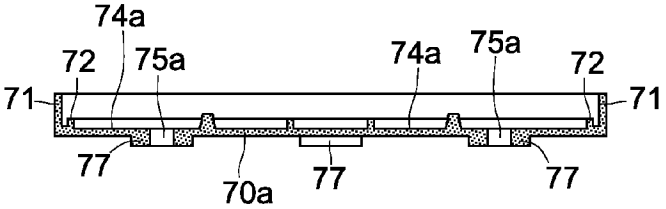
FIG. 47 is a cross sectional view taken against the section line of 47-47 from previous FIG. 46.
Figure 49:
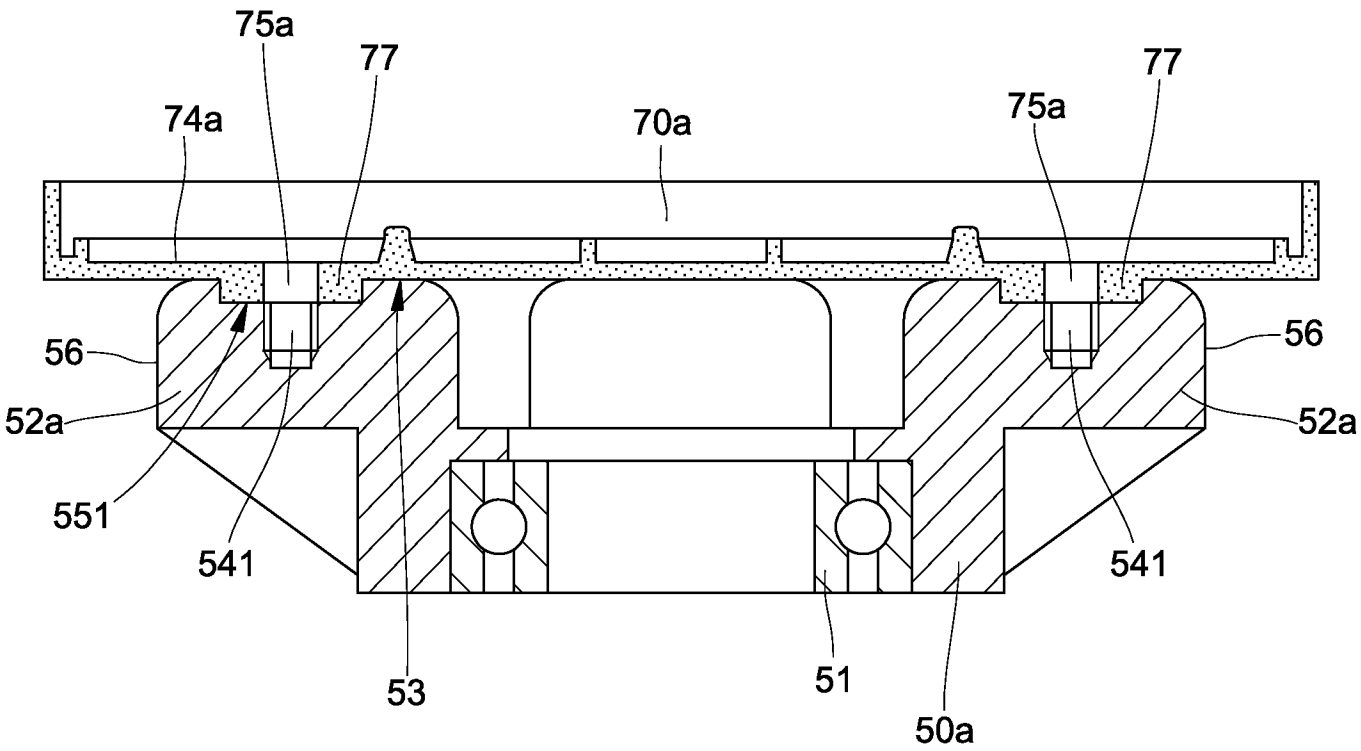
FIG. 49 is a partial cross sectional view for the third exemplary embodiment in an essential configuration of the present invention assembled in the combination of a changed eccentric roundel mount and an altered diaphragm membrane in a changed configuration of the conventional four-booster-chamber diaphragm pump.

Please refer to FIGS. 44 through 49, which are illustrative views for a changed "eccentric roundel structure for four-booster-chamber diaphragm pump" in a changed configuration for the conventional "four-booster-chamber diaphragm pump" such that it has a changed diaphragm membrane 70*a* and a changed eccentric roundel mount 50*a* with a changed truncated cylinder eccentric roundel 52*a*. Wherein, the truncated-cylinder eccentric roundels 52 and the diaphragm membrane 70 of the eccentric roundel mount 50 in an essential configuration of the conventional "four-booster-chamber diaphragm pump" are changed into a changed truncated-cylinder eccentric roundels 52*a* with a horizontal top face 53 and a changed diaphragm membrane 70*a* with a piston acting zone 74*a* for the changed eccentric roundel mount 50*a* here such that each horizontal top face 53 of the changed truncated-cylinder eccentric roundels 52*a* has a positioning cavity 551 with a female-threaded bore 541 (as shown in FIGS. 44 and 45) while each conventional piston acting zone 74 of the diaphragm membrane 70 is changed into each piston acting zone 74*a* of the changed diaphragm membrane 70*a* having a piston acting zone 74*a* with a round positioning protrusion 77 respectively (as shown in FIGS. 47 and 48) so that the changed truncated-cylinder eccentric roundels 52*a* and changed diaphragm membrane 70*a* can be firmly mated each other by means of securely mating between the positioning cavity 551 of the changed truncated-cylinder eccentric roundels 52*a* and the round positioning protrusion 77 of the changed diaphragm membrane 70*a* (as shown in FIG. 49).

Figure 16:
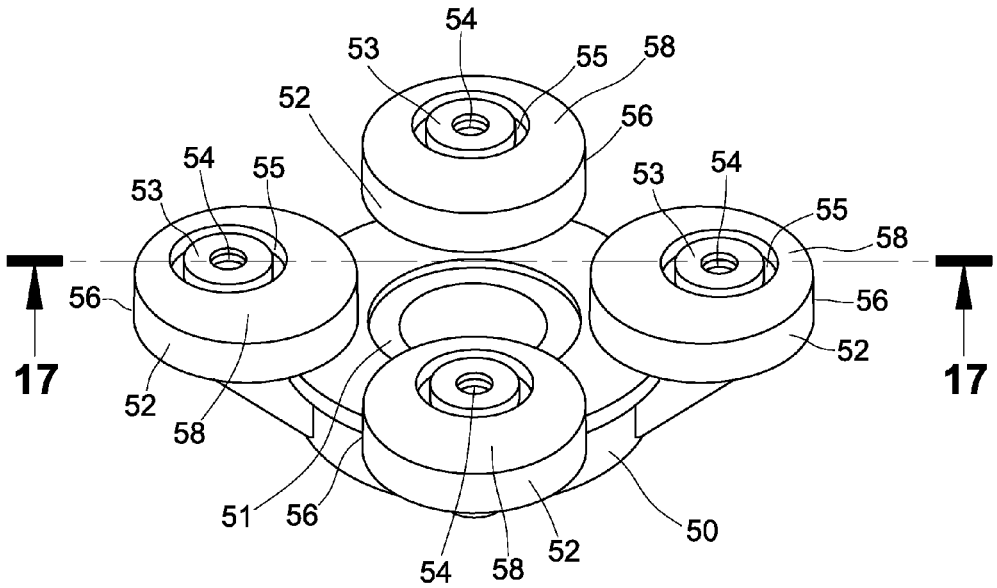
FIG. 16 is a perspective view for eccentric roundel mount in an essential configuration of the first exemplary embodiment of the present invention.
Figure 17:
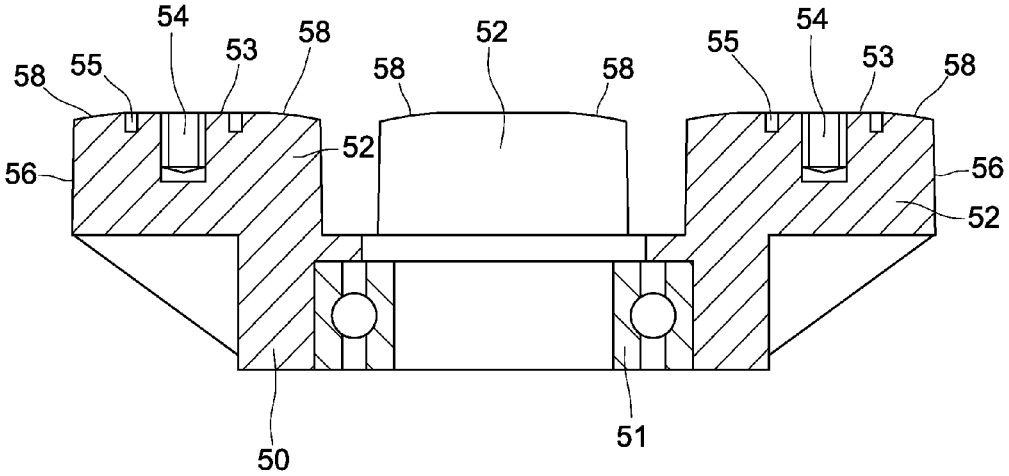
FIG. 17 is a cross sectional view taken against the section line of 17-17 from previous FIG. 16.
Figure 18:
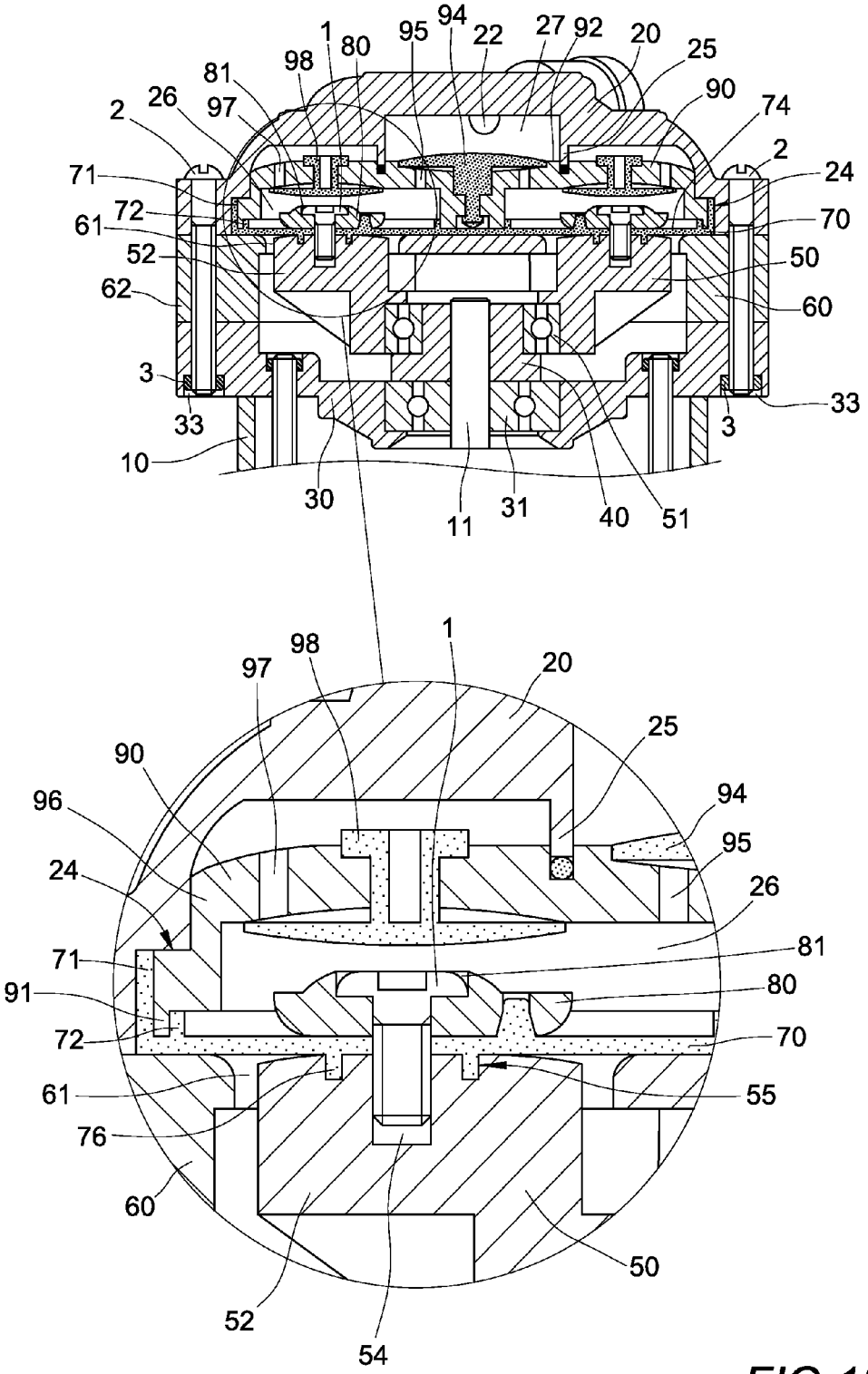
FIG. 18 is a partial cross sectional view in the first exemplary embodiment for an eccentric roundel structure in an essential configuration of the present invention installed in the essential configuration of a conventional four-booster-chamber diaphragm pump.
Figure 50:
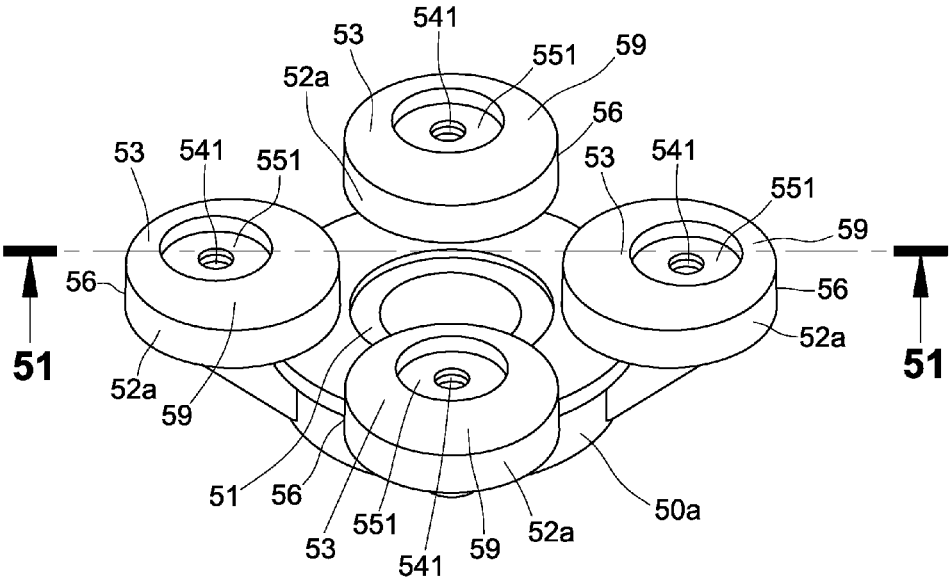
FIG. 50 is a perspective view for the fourth exemplary embodiment in an altered configuration of the present invention.
Figure 51:
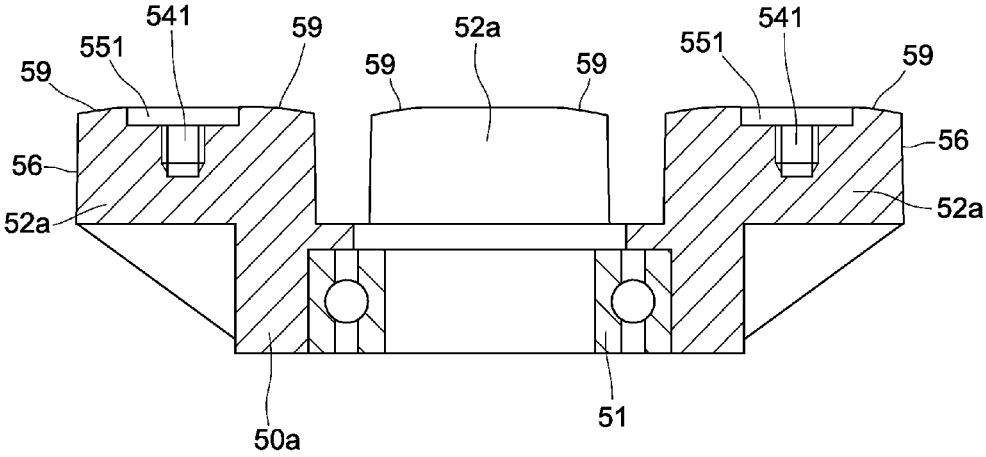
FIG. 51 is a cross sectional view taken against the section line of 51-51 from previous FIG. 50.
Figure 52:
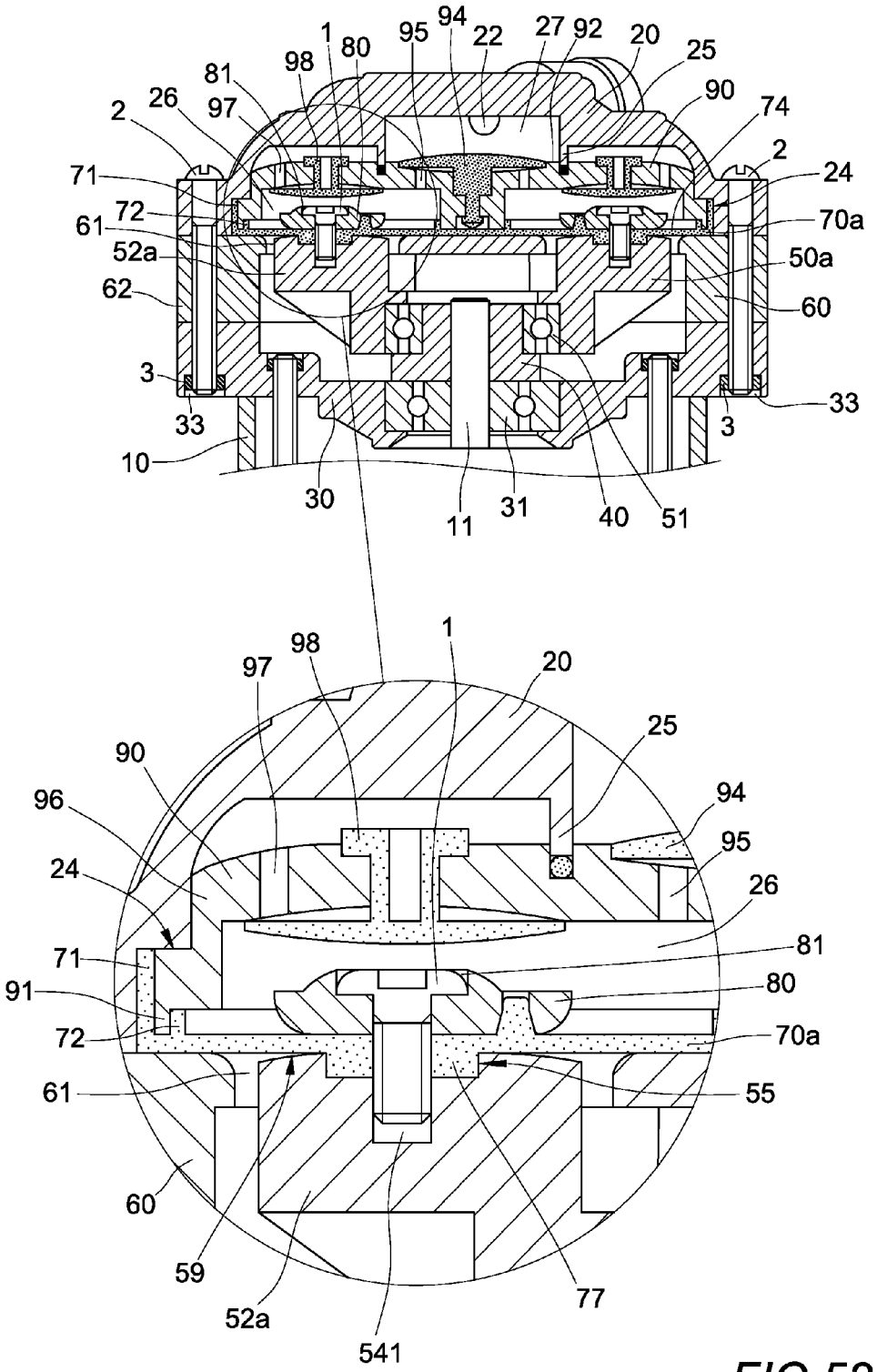
FIG. 52 is a partial cross sectional view in the fourth exemplary embodiment for an eccentric roundel structure in an altered configuration of the present invention installed in the combination of an altered eccentric roundel mount and an altered diaphragm membrane for an essential configuration of the conventional four-booster-chamber diaphragm pump.
Figure 53:
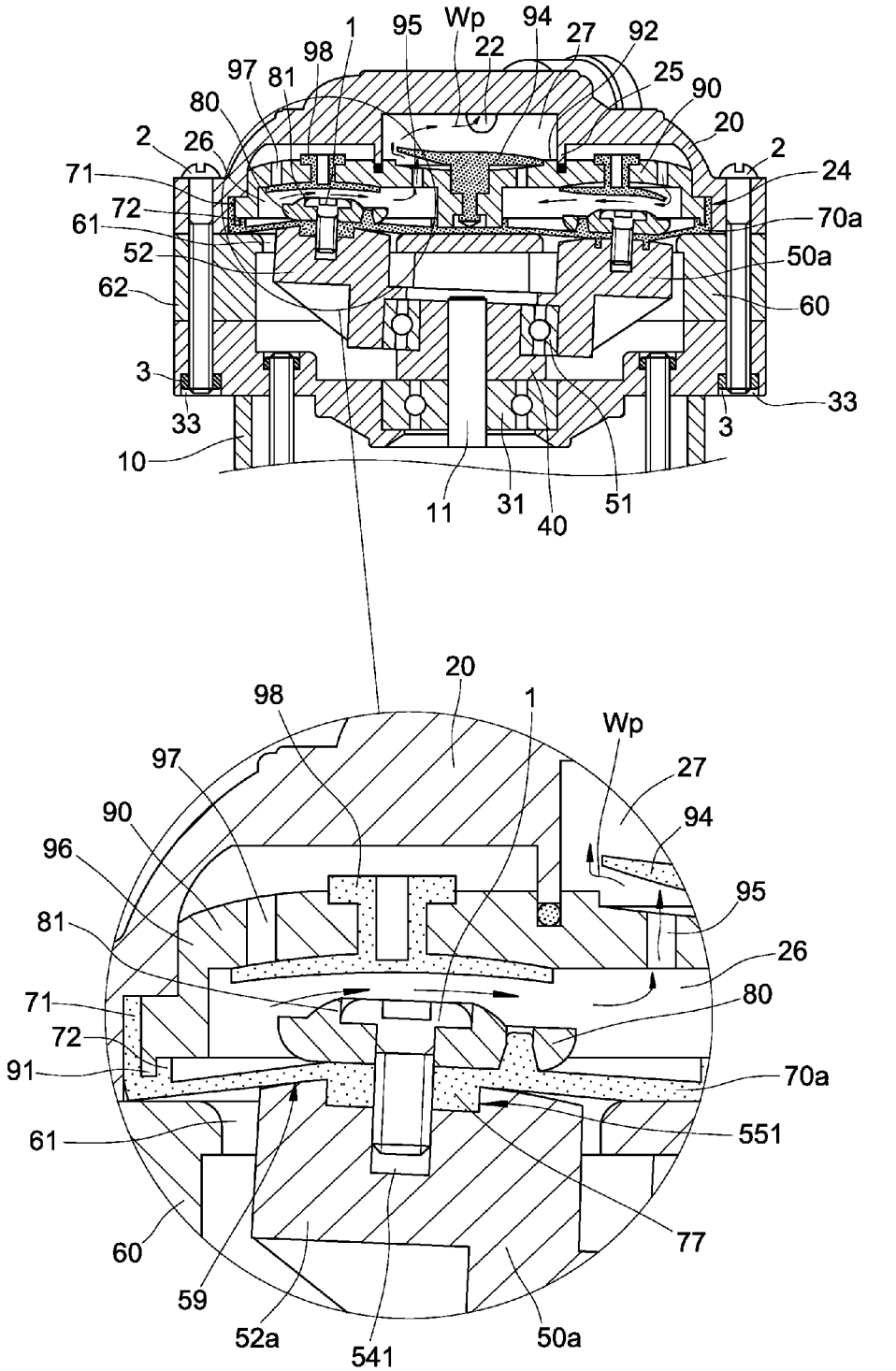
FIG. 53 is an operation illustrative view for an altered configuration of the fourth exemplary embodiment of the present invention.

Please refer to FIGS. 50 through 53, which are illustrative figures of "eccentric roundel structure for four-booster-chamber diaphragm pump" in an altered configuration for the fourth exemplary embodiment of the present invention such that each of the four eccentric roundel structures is an altered truncated-cylinder eccentric roundel 52*a* in an eccentric roundel mount 50*a*. Wherein, the sloped top rim 58, which is downwardly slanted from the annular positioning dent 55 towards the truncated cylinder peripheral 56 in the essential configuration for the first exemplary embodiment of the present invention (as shown in FIGS. 16 and 17), is altered into a downwardly sloped meniscus rim 59, which is defined from each positioning cavity 551 of each truncated-cylinder eccentric roundel 52*a* to each corresponding truncated cylinder peripheral 56 here (as shown in FIGS. 50 and 51).

In conclusion the disclosure heretofore, by means of simple contrivance in the variety of the truncated-cylinder eccentric roundels and sloped top rim for the four-booster-chamber diaphragm pump of the present invention, not only the service lifespan of the diaphragm membrane but also the service lifespan of the four-booster-chamber diaphragm pump can be doubly extended. Accordingly, the present invention meets the essential criterion of the patent. Therefore, we submit the application for patent in accordance with related patent laws.

What is claimed is:

1. An eccentric roundel structure for a four-booster-chamber diaphragm pump, comprising: a motor with an output shaft, a motor upper chassis, a wobble plate with an integral protruding cam-lobed shaft, an eccentric roundel mount, a pump head body, a diaphragm membrane, four pumping pistons, a piston valvular assembly and a pump head cover, wherein:

said motor upper chassis includes a bearing through which the output shaft of the motor extends, and an upper annular rib ring with several fastening bores evenly disposed around a circumference of the motor upper chassis;

said wobble plate with the integral protruding cam-lobed shaft includes a shaft coupling hole through which the output shaft of the motor extends;

said eccentric roundel mount includes a central bearing securely fitted at a bottom base thereof for engaging with the corresponding wobble plate with integral protruding cam-lobed shaft, four truncated-cylinder eccentric roundels evenly disposed on the bottom base thereof in circumferential location such that each truncated-cylinder eccentric roundel characteristically has a horizontal top face, a female-threaded bore and an annular positioning groove formed on the top face, as well as a sloped top rim downwardly slanted from the annular positioning groove towards a periphery of the respective truncated-cylinder eccentric roundel;

said pump head body, which covers the upper annular rib ring of the motor upper chassis to encompass the wobble plate with the integral protruding cam-lobed shaft and the eccentric roundel mount therein, includes four operating holes disposed therein at evenly-spaced circumferential locations such that each operating hole has an inner diameter slightly bigger than an outer diameter of a respective truncated-cylinder eccentric roundel in the eccentric roundel mount for receiving the respective truncated-cylinder eccentric roundel, a lower annular flange formed thereunder for mating with a corresponding upper annular rib ring of the motor upper chassis, and several fastening bores disposed therein at even circumferential locations;

said diaphragm membrane is a semi-rigid elastic membrane on the pump head body, and includes an outer raised brim and an inner raised brim, each extending around a periphery of the diaphragm membrane, as well as four evenly spaced radial raised partition ribs having ends connected with the inner raised brim, four equivalent piston acting zones being formed and partitioned by the radial raised partition ribs, wherein each piston acting zone has an acting zone hole created therein in correspondence with each female-threaded bore in the truncated-cylinder eccentric roundel of the eccentric roundel mount respectively, and an annular positioning protrusion for each acting zone hole is formed at a bottom side of the diaphragm membrane;

the pumping pistons are respectively disposed in the piston acting zones of the diaphragm membrane, and each pumping piston has a tiered hole;

each annular positioning protrusion in the diaphragm membrane is inserted into a respective said annular positioning groove in the truncated-cylinder eccentric roundel of the eccentric roundel mount, which is fastened to the diaphragm membrane by a fastening screw that extends through the tiered hole of each pumping piston and the acting zone hole of each corresponding piston acting zone in the diaphragm membrane, and that is screwed into each female-threaded bore of corresponding four truncated-cylinder eccentric roundels in the eccentric roundel mount;

said piston valvular assembly covers the diaphragm membrane and includes a downwardly extending brim inserted between the outer raised brim and inner raised brim of the diaphragm membrane, a central dish-shaped round outlet mount having a central positioning bore with four equivalent sectors, each of which contains multiple circumferentially located outlet ports, a T-shaped plastic anti-backflow valve with a central positioning shank, and four adjacent inlet mounts, each of which includes multiple circumferentially located inlet ports and an inverted central piston disk, respectively; and the pump head cover, which covers the pump head body to encompass the piston valvular assembly, four pumping pistons and diaphragm membrane therein, includes a water inlet orifice, a water outlet orifice, and several internal and external fastening bores, and a tiered rim and an annular rib ring are disposed in a bottom inside of the pump head cover, and the outer raised brim of the diaphragm membrane, after assembly of the diaphragm membrane to the piston valvular assembly, is hermetically attached to the tiered rim of the pump head cover.

2. The eccentric roundel structure for four-booster-chamber diaphragm pump as claimed in claim 1, wherein the periphery of each of the truncated-cylinder eccentric roundels of the eccentric roundel mount are formed as an inwardly curving meniscus to form a flanged truncated-cylinder eccentric roundel such that the outer diameter of the eccentric roundel is still smaller than the inner diameter of the corresponding operating hole of the pump head body, said sloped top rim forming a sloped meniscus rim that is downwardly inclined from the annular positioning groove towards the periphery of the truncated-cylinder eccentric roundel.

3. The eccentric roundel structure for four-booster-chamber diaphragm pump as claimed in claim 2, wherein each said periphery of the truncated-cylinder eccentric roundels includes a flange at an upper end of the inwardly curving meniscus.

4. The eccentric roundel structure for four-booster-chamber diaphragm pump as claimed in claim 2, wherein:

each of the truncated-cylinder eccentric roundels of the eccentric roundel mount is comprises a roundel mount and a truncated cylinder yoke in detachable separation, the truncated cylinder yoke includes a respective periphery formed as said inwardly curving meniscus, said roundel mount is a two-layered frustum that includes a bottom-layer base with a positional crescent facing inwardly and a top-layer protruded cylinder with a central female-threaded bore, said truncated cylinder yoke is fitted as a sleeve over the corresponding roundel mount, said truncated cylinder yoke includes an upper bore, a middle bore and a lower bore stacked as a three-layered integral hollow frustum, wherein a bore diameter of the upper bore is bigger than an outer diameter of the protruded cylinder, a bore diameter of the middle bore is equal to the outer diameter of the protruded cylinder, and the bore diameter of the lower bore is equal to an outer diameter of the bottom-layer base in the roundel mount, and said annular positioning groove is formed between the outer wall of the protruded cylinder and an inside wall of the upper bore when the truncated cylinder yoke is sleeved over each respective one of the roundel mounts.

5. The eccentric roundel structure for four-booster-chamber diaphragm pump as claimed in claim 4, wherein each said truncated cylinder yoke having said periphery formed as a truncated inwardly curving meniscus includes a flange at an upper end of the inwardly curving meniscus.

6. An eccentric roundel structure for a four-booster-chamber diaphragm pump, comprising: a motor with an output shaft, a motor upper chassis, a wobble plate with an integral protruding cam-lobed shaft, an eccentric roundel mount, a pump head body, a diaphragm membrane, four pumping pistons, a piston valvular assembly and a pump head cover, wherein:

said motor upper chassis includes a bearing through which the output shaft of the motor extends, and an upper annular rib ring with several fastening bores evenly disposed around a circumference of the motor upper chassis;

said wobble plate with the integral protruding cam-lobed shaft includes a shaft coupling hole through which the output shaft of the motor extends;

said eccentric roundel mount includes a central bearing securely fitted at a bottom base thereof for engaging with the corresponding wobble plate with integral protruding cam-lobed shaft, four truncated-cylinder eccentric roundels evenly disposed on the bottom base thereof in circumferential location such that each truncated-cylinder eccentric roundel has a horizontal top face, a round positioning cavity with a female-threaded bore formed on the top face, as well as a sloped meniscus rim downwardly slanted from the round positioning cavity towards a periphery of the respective truncated-cylinder eccentric roundel;

said pump head body, which covers the upper annular rib ring of the motor upper chassis to encompass the wobble plate with the integral protruding cam-lobed shaft and the eccentric roundel mount therein, includes four operating holes disposed therein at evenly-spaced circumferential locations such that each operating hole has an inner diameter slightly bigger than an outer diameter of a respective truncated-cylinder eccentric roundel in the eccentric roundel mount for receiving the respective truncated-cylinder eccentric roundel, a lower annular flange formed thereunder for mating with a corresponding upper annular rib ring of the motor upper chassis, and several fastening bores disposed therein at even circumferential locations;

said diaphragm membrane is a semi-rigid elastic membrane on the pump head body, and includes an outer raised brim and an inner raised brim, each extending around a periphery of the diaphragm membrane, as well as four evenly spaced radial raised partition ribs having ends connected with the inner raised brim, four equivalent piston acting zones being formed and partitioned by the radial raised partition ribs, wherein each piston acting zone has an acting zone hole created therein in correspondence with each female-threaded bore in the truncated-cylinder eccentric roundel of the eccentric roundel mount respectively, and a round positioning protrusion for each acting zone hole is formed at a bottom side of the diaphragm membrane;

the pumping pistons are respectively disposed in the piston acting zones of the diaphragm membrane, and each pumping piston has a tiered hole;

each annular positioning protrusion in the diaphragm membrane is inserted into a respective said annular positioning groove in the truncated-cylinder eccentric roundel of the eccentric roundel mount, which is fastened to the diaphragm membrane by a fastening screw that extends through the tiered hole of each pumping piston and the acting zone hole of each corresponding piston acting zone in the diaphragm membrane, and that is screwed into each female-threaded bore of corresponding four truncated-cylinder eccentric roundels in the eccentric roundel mount;

said piston valvular assembly covers the diaphragm membrane and includes a downwardly extending brim inserted between the outer raised brim and inner raised brim of the diaphragm membrane, a central dish-shaped round outlet mount having a central positioning bore with four equivalent sectors, each of which contains multiple circumferentially located outlet ports, a T-shaped plastic anti-backflow valve with a central positioning shank, and four adjacent inlet mounts, each of which includes multiple circumferentially located inlet ports and an inverted central piston disk, respectively;

said pump head cover, which covers the pump head body to encompass the piston valvular assembly, four pumping pistons and diaphragm membrane therein, includes a water inlet orifice, a water outlet orifice, and several internal and external fastening bores, and a tiered rim and an annular rib ring are disposed in a bottom inside of the pump head cover, and the outer raised brim of the diaphragm membrane, after assembly of the diaphragm membrane to the piston valvular assembly, is hermetically attached to the tiered rim of the pump head cover.

7. The eccentric roundel structure for four-booster-chamber diaphragm pump as claimed in claim 6, wherein the periphery of each of the truncated-cylinder eccentric roundels of the eccentric roundel mount are formed as an inwardly curving meniscus to form a flanged truncated-cylinder eccentric roundel such that the outer diameter of the eccentric roundel is still smaller than the inner diameter of the corresponding operating hole of the pump head body.

8. The eccentric roundel structure for four-booster-chamber diaphragm pump as claimed in claim 7, wherein each said periphery of the truncated-cylinder eccentric roundels includes a flange at an upper end of the inwardly curving meniscus.

* * * * *